US012161184B2

(12) United States Patent
Drake et al.

(10) Patent No.: US 12,161,184 B2
(45) Date of Patent: Dec. 10, 2024

(54) PERSONALIZED FOOTWEAR ASSEMBLY WITH ALIGNMENT PANELS

(71) Applicant: Drake Labs, Inc., Seattle, WA (US)

(72) Inventors: Stephan Drake, Salt Lake City, UT (US); Robert John Horacek, Park City, UT (US); Raymond Alfred Horacek, Yokohama (JP)

(73) Assignee: Drake Labs, Inc., Seattle, WA (US)

( * ) Notice: Subject to any disclaimer, the term of this patent is extended or adjusted under 35 U.S.C. 154(b) by 68 days.

(21) Appl. No.: 17/856,873

(22) Filed: Jul. 1, 2022

(65) Prior Publication Data

US 2023/0038740 A1 Feb. 9, 2023

Related U.S. Application Data

(60) Provisional application No. 63/217,717, filed on Jul. 1, 2021.

(51) Int. Cl.

| | |
|---|---|
| ***A43B 5/14*** | (2006.01) |
| ***A43B 7/1405*** | (2022.01) |
| ***A43B 7/20*** | (2006.01) |
| ***A43B 13/14*** | (2006.01) |
| ***A43C 11/20*** | (2006.01) |

(52) U.S. Cl.

CPC ..... *A43B 13/14* (2013.01); *A43B 5/14* (2013.01); *A43B 7/141* (2013.01); *A43B 7/20* (2013.01); *A43C 11/20* (2013.01)

(58) Field of Classification Search

None

See application file for complete search history.

(56) References Cited

U.S. PATENT DOCUMENTS

| | | | | |
|---|---|---|---|---|
| 1,863,592 A * | 6/1932 | Dawes | A43C 11/004 | 36/50.1 |
| 2,444,640 A * | 7/1948 | Epstein | A43C 11/12 | 36/11 |
| 3,657,827 A * | 4/1972 | Rieker | A43B 23/22 | 36/117.6 |

(Continued)

FOREIGN PATENT DOCUMENTS

| | | |
|---|---|---|
| FR | 2963213 B1 | 4/2013 |
| GB | 2251543 A | 7/1992 |
| WO | 2019232121 A1 | 12/2019 |

OTHER PUBLICATIONS

International Searching Authority, International Search Report and Written Opinion, PCT Patent Application PCT/US2022/036022, mailed Nov. 1, 2022, 12 pages.

*Primary Examiner* — Ted Kavanaugh
(74) *Attorney, Agent, or Firm* — Perkins Coie LLP

(57) ABSTRACT

A footwear assembly, such as a cycling show, includes a plantar shell, a dorsal shell, and a closure mechanism. The plantar shell that at least partially defines an interior area sized to receive a wearer's foot and is shaped to conform to a bottom surface contour of the wearer's foot. The dorsal shell shaped to conform to an upper surface contour of the wearer's foot and includes a region positioned to apply a compressive force to a portion of the wearer's foot. The closure mechanism configured to couple the dorsal shell to the plantar shell to apply the compressive force to the portion of the wearer's foot to at least partially prevent movement of the wearer's foot relative to the plantar shell.

24 Claims, 37 Drawing Sheets

(56) References Cited

U.S. PATENT DOCUMENTS

| | | | | |
|---|---|---|---|---|
| 4,856,209 | A | 8/1989 | Kenyon | |
| 5,117,567 | A * | 6/1992 | Berger | A43C 11/16 36/50.1 |
| 5,381,611 | A * | 1/1995 | Tonel | A43B 5/04 36/117.1 |
| 7,331,128 | B1 * | 2/2008 | Navasky | A43B 23/26 36/101 |
| 7,856,740 | B2 | 12/2010 | De Bast et al. | |
| 10,241,498 | B1 | 3/2019 | Beard et al. | |
| 2002/0184795 | A1 * | 12/2002 | Kan | A43B 5/1633 36/100 |
| 2012/0240428 | A1 * | 9/2012 | Knoll | A43B 5/0427 36/50.1 |
| 2013/0340292 | A1 * | 12/2013 | Cook | A43B 9/00 36/131 |
| 2017/0000210 | A1 * | 1/2017 | Bigolin | A43C 11/16 |
| 2018/0160764 | A1 | 6/2018 | Garneau et al. | |
| 2019/0142112 | A1 * | 5/2019 | Ramsay | A43B 3/24 36/50.1 |
| 2019/0223555 | A1 * | 7/2019 | Iannuzzi | A43B 1/0027 |

* cited by examiner

PERSONALIZED FOOTWEAR ASSEMBLY WITH ALIGNMENT PANELS

CROSS REFERENCE TO RELATED APPLICATIONS

This non-provisional patent application claims the benefit of and priority to U.S. Provisional Patent Application No. 63/217,717, titled Personalized Footwear Assembly with Alignment Panels, filed Jul. 1, 2021, which is incorporated herein in its entirety by reference thereto.

TECHNICAL FIELD

Embodiments of the present invention are directed to footwear, and more particularly to personalized performance footwear systems with enhanced support, fit, and responsiveness for the wearer's feet.

BACKGROUND

Footwear that properly fits a wearer's feet, particularly for high-performance activities, is extremely important. People's feet, ankles, and lower legs, however, are all different with different sizes, shapes, alignment, and/or relative motion during subtle and dynamic activities. Conventional footwear is typically constructed with a small range of sizes (lengths and widths), so each size can generally fit a wide variety of feet. As a result, conventional footwear provides a rough fit for a person's foot but does not provide a personalized fit for a person's specific foot shape and arrangement. In performance activities, such as cycling, skiing, snowboarding, skating, etc., the associated footwear must allow for efficient force and load transfer between the wearer's foot, ankle, and lower leg to the associated equipment (i.e., pedals, skis, boards, blades, wheels, etc.). If the footwear is inefficient or does not adequately facilitate the force and load transfer, performance of the activity can substantively suffer.

Conventional performance footwear often tries to maintain efficient force and load transfer by providing laces, straps, buckles, or other closure systems for a tight fit. The uppers can also be made of stiff material with reduced flex to improve load transfer through the footwear. Unfortunately, this conventional tight performance fit typically sacrifices comfort for the wearer's feet. This conventional tight performance fit also does not adequately address pronation, supination, collapsed arch, or other foot alignment of the wearer's foot within the shoe or boot. Accordingly, custom footbeds, orthotics, or other additional support structures are often used within the shoe or boot to provide additional foot support, thereby adding to the complexity and cost of the footwear. These internal foot support structures attempt to control foot position or movement relative to a neutral stance from under the foot, which can cause issues with the wearer's nerves in the foot and leg and other negative restrictions to foot alignment or movement.

The human foot is a complex structure that can undergo a wide range of movements during high-performance activities. Too much movement of the foot structure within the footwear during dynamic movement, including monopedal and bipedal stances or movements, can have a negative impact on the force and load transfer to or from the footwear. Some conventional footwear systems have used a forefoot/midfoot compression system to apply a downward force on the foot's top portion above the instep. This downward compression seeks to minimize foot movement and restrict the maximum height of the foot's instep within the footwear at all times independent of the movement or position of the foot during an activity. Examples of such systems are disclosed in U.S. Pat. Nos. 4,534,122, 5,265,350, 5,459,949, and 5,634,284, and U.S. Patent Application Publication No. 2016/0242494, all of which are incorporated herein by reference thereto. The systems, however, are complex and can be expensive to integrate into performance footwear. Accordingly, there is a need for improved footwear that achieves a precise and personalized fit, control, and comfort for a specific wearer's foot shape, size, and alignment, while maintaining comfort and ease of use.

DETAILED DESCRIPTION

Figure 1:
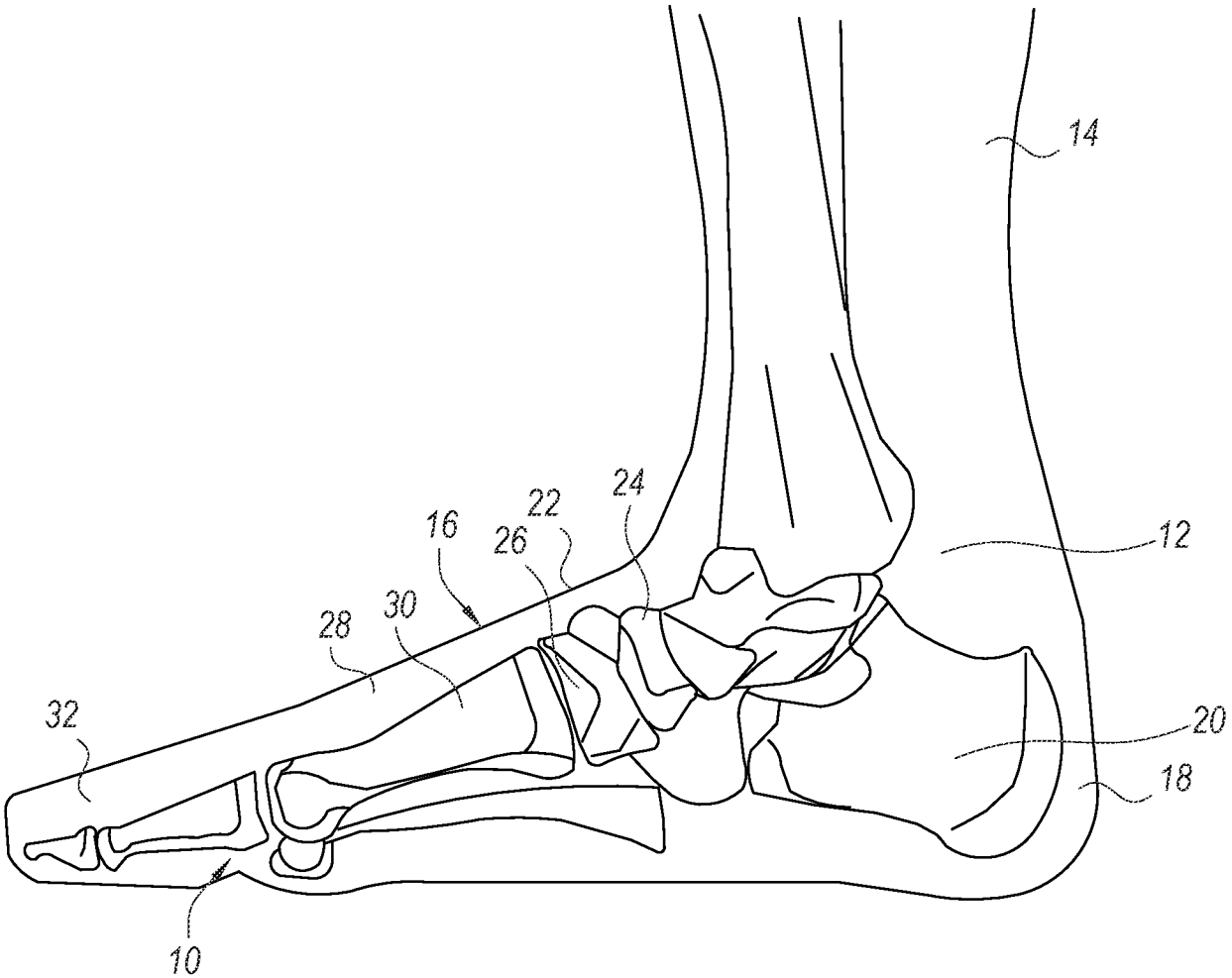
FIG. 1 is a schematic view of a foot, ankle, and lower leg of a human wearer.

The present technology provides footwear assemblies configured with a precise, personalized, performance fit for each wearer, along with associated manufacturing processes that overcome problems and drawbacks experienced by the prior art and that provide other benefits. A footwear assembly in accordance with embodiments of the present technology provide a personalized plantar shell defining an interior area shaped and sized to receive and contain a wearer's foot. The plantar shell is custom fit to the specific shape, size, and arrangement of the individual wearer's foot, such as from a 3-D foot scan, so as to precisely fit the wearer's foot. The plantar shell has an opening in the top area configured to allow the user to insert or remove the foot from the interior area and to expose the dorsal area of the wearer's foot forward of the ankle and above the instep area.

The plantar shell around the opening securely connects to a personalized, customized dorsal shell that extends over the foot's instep and covers the opening of the plantar shell. The configuration and engagement between the plantar and dorsal shells create a precision-fit caging system that securely contains and controls the wearer's foot, particularly during dynamic activities and motions. The dorsal shell, when in the closed position over the plantar shell, firmly engages the top instep portion of the foot, such that the dorsal shell compresses and pre-loads the wearer's instep within the caging system. In some embodiments, a seal is provided between the plantar and dorsal shells, so as to provide a water-tight seal between the plantar and dorsal shells.

The footwear assembly has one or more closure devices coupled to the plantar and dorsal shells to releasably hold the dorsal shell closed and to apply pressure to the instep of the wearer's foot. The closure device can be released to allow the dorsal shell to be moved to the open position for removal of the wearer's foot.

The footwear of the present technology is constructed specifically for the wearer's foot by 3-D printing (or other additive manufacturing techniques) of the plantar and dorsal shells based on a 3-D scan or other 3-D model of the wearer's foot. Other embodiments can utilize other manufacturing techniques, including non-additive manufacturing, while still providing the personalized construction and fit for the particular wearer's foot. The footwear assembly can be a shoe, boot, sandal, mule, or other footwear style.

Several specific details of the personalized footwear technology and associated fitting and manufacturing processes of the present technology are set forth in the following description and the Figures to provide a thorough understanding of certain embodiments of the invention. One skilled in the art, however, will understand that the present invention may have additional embodiments, and that other embodiments of the invention may be practiced without several of the specific features described below. Further, at least some aspects of the present technology can be generally similar or identical in structure and/or function to one or more features of the personalized footwear disclosed in Applicant's U.S. patent application Ser. No. 17/670,367, filed Feb. 11, 2022, titled Personalized Footwear with Integrated Caging System, which is incorporated herein in its entirety by reference thereto. The technology of the present disclosure provides additional advancements to footwear technologies, including cycling shoe technologies.

Although certain aspects of the present technology are described and/or illustrated with reference to a left foot or a right foot of a wearer, a person of ordinary skill in the art will appreciate that the present technology can be used with another of the wearer's feet, and/or with both of the wearer's feet. For example, at least some embodiments of the present technology can include a first personalized footwear assembly customized for the wearer's left foot and/or a second personalized footwear assembly customized for the wearer's right foot.

For purposes of discussion and reference, FIG. 1 is a schematic view of a person's foot 10, ankle 12, and lower leg 14. The foot 10 has a heel portion 18 including the calcaneus bone 20, an instep portion 22 including the navicular and cuneiform bones 24 and 26, and a forefoot portion 28 including the metatarsals bones 30. The top 16 of the foot 10 extends from the ankle 12, over the instep portion 22, to the toes 32.

Figure 2C:
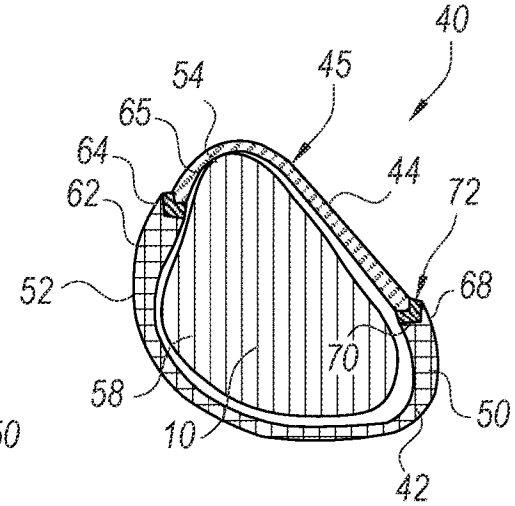
FIG. 2C is a cross-sectional view taken substantially along line 2C-2C of FIG. 2B.
Figure 2B:
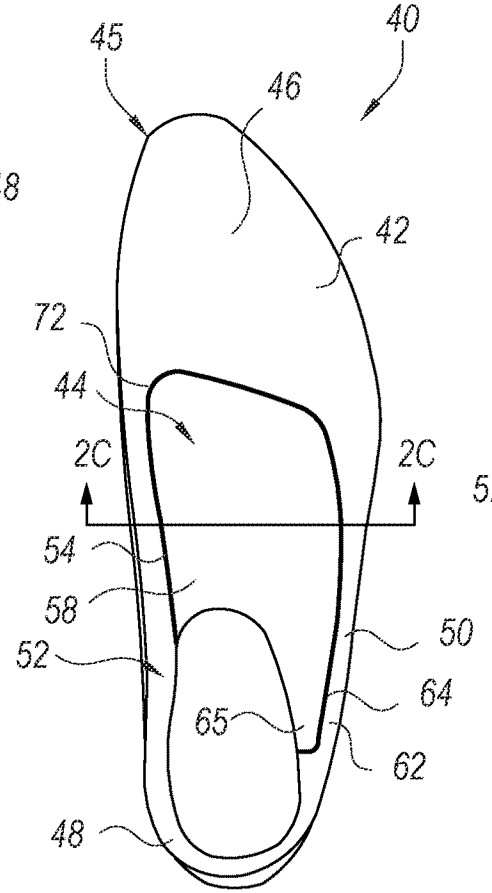
FIG. 2B is a plan view of the footwear assembly of FIG. 2A.
Figure 2A:
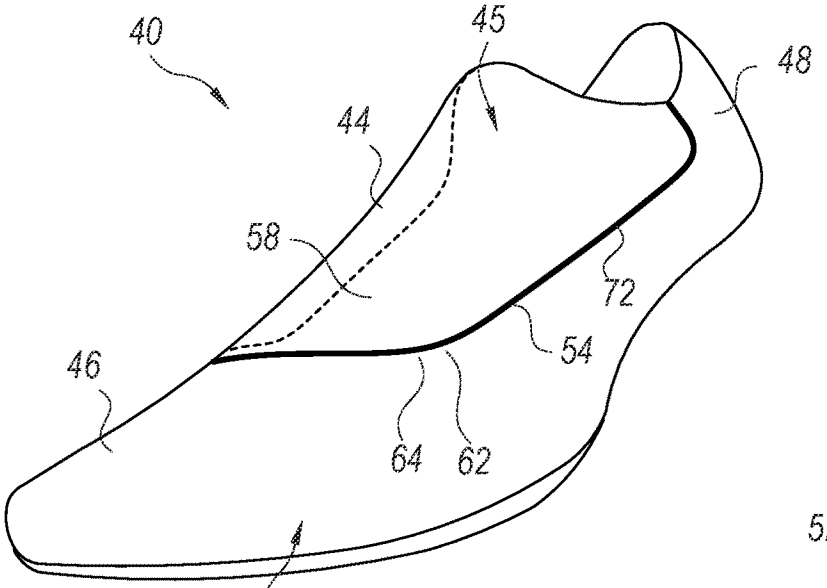
FIG. 2A is an isometric view of a footwear assembly in accordance with an embodiment of the present technology.

FIGS. 2A and 2B are isometric and top plan views of a footwear assembly 40 in accordance with an embodiment of the present technology. FIG. 2C is a cross-sectional view of the footwear assembly 40 taken substantially along line 2C-2C of FIG. 2B. As discussed in greater detail below, the footwear assembly 40 comprises personalized plantar and dorsal shells 42 and 44, respectively, precisely fit for a particular wearer's foot 10 (FIG. 1) to provide a caging system 45. The caging system 45 engages, captures, and retains the foot 10 in a comfortable and secure manner to facilitate performance in highly dynamic performance sports activities, such as cycling, skiing, snowboarding, skating, climbing, hiking, riding, and other activities. It is noted that the foot 10 for which the footwear assembly 40 is built may be a bare foot, a socked foot, a liner-covered foot, or other covered foot configuration. The footwear assembly 40 is configured to minimize movement of the foot 10 (FIG. 1) within caging system 45 to facilitate extremely efficient and precise load transfer between the wearer's foot 10 and the external environment, such as pedals, skis, a snowboard, a skate blade, wheels, the ground, or other external environments or components. The personalized construction of the footwear for the particular wearer's foot also allows for constructing an extremely comfortable fit around the wearer's foot substantially without sacrificing performance of the footwear assembly 40.

The footwear assembly 40 illustrated in FIGS. 2A-2C is a cycling shoe that has a contoured plantar shell 42 with a forefoot portion 46 that receives and is conformed to the forefoot portion of the wearer's foot. The plantar shell 42 also has a contoured heel portion 48 configured to receive and securely retain the foot's heel portion 18 (FIG. 1). Lateral and medial sidewalls 50 and 52 of the plantar shell 42 extend between the shoe's forefoot and heel portions 46 and 48. The plantar shell 42 has an upper opening 54 through which the wearer can insert or remove his or her foot from the plantar shell's interior area 58. The opening 54 is sized so that, when the wearer's foot is in the plantar shell 42, the top of the foot at the instep portion 22 (FIG. 1) is positioned within the opening 54.

The dorsal shell 44 is attached to the plantar shell 42 and is movable between an open position away from the opening 54 and a closed position covering the opening 54. When the dorsal shell 44 is in the open position, the wearer can insert or remove his or her foot from the plantar shell 42 through the opening 54. When the dorsal shell 44 is in the closed position, the dorsal shell 44 is positioned over and covers the foot's instep portion 22 (FIG. 1). The plantar and dorsal shells 42 and 44 are sized so that, when the dorsal shell 44 is in the closed position, the foot is firmly yet comfortably captured in the caging system 45. Also, the dorsal shell 44 firmly presses against the top of the wearer's foot along the instep portion 22 (FIG. 1) and applies a compressive downward force on the instep portion 22. Accordingly, the dorsal shell 44 in the closed position pre-compresses the foot's instep portion 22 (FIG. 1) with the caging system 45.

The precise and personalized fit of the plantar and dorsal shells 42 and 44 for the specific shape, size, and contour of individual wearer's foot 10 (FIG. 1) allows for an extremely comfortable fit that minimizes pressure points and limits undesired excessive foot movement within the caging system 45. Further, the contour and arrangement of the dorsal shell 44 is based on the actual foot shape, so that the dorsal shell 44 can be constructed to provide specific compressive loads against selected portions of wearer's instep portion 22 (FIG. 1). These directed compressive loads can provide for correction or modification of a foot's alignment, such as pronation, supination, and/or other alignment and/or movement of the foot. For example, the dorsal shell 44 can be constructed to provide a greater compressive load on the upper medial side or on the upper lateral side of the foot's instep area, depending upon the specific anatomy of the wearer's foot, ankle, and lower leg.

In conventional footwear, the top of a shoe or boot covers the instep portion but does not pre-compress the instep portion 22. During performance activities, the foot undergoes dynamic motion and can be subject to significant forces so as to compress the instep and flex the foot's skeletal structure. This motion of the foot within the conventional shoe can significantly reduce the efficiency of load and force transfer between the foot, the footwear, and the external equipment or environment. The footwear assembly 40 of the present technology provides the personalized caging system 45 via the plantar and dorsal shells 42 and 44, so the foot is closely contained in the interior area and is firmly restrained from excessive linear motion (longitudinal and lateral/medial motion) and rotational motion relative to the plantar and dorsal shells 42 and 44. The dorsal shell's pre-compression of the foot's instep portion 22 reduces the flexural motion of the instep portion 22 within the caging system 45, thereby providing an extremely efficient force and load transfer to and from the wearer's foot 10, ankle 12, and/or lower leg 14 (FIG. 1) during an activity, such as a high-performance activity.

Referring again to FIGS. 2A-2C, the opening 54 in the plantar shell 42 is defined by a perimeter engagement portion 62 that extends above the lateral and medial sidewalls 50 and 52 and extends across the forefoot portion 46. The engagement portion 62 has an integrated locking feature 64 that mateably engages with a locking feature 65 on the perimeter edge portion 66 of the dorsal shell 44 when the dorsal shell 44 is in the closed position.

As best seen in FIG. 2C, the engagement portion 62 of the plantar shell has a stepped lock configuration with a shoulder member 68 extending upwardly from a generally horizontal support surface 70. Accordingly, the locking feature 64 has a generally L-shaped cross-section. The locking feature 65 on the dorsal shell's edge portion 66 has a mating shape that securely fits into and engages the plantar shell's locking feature 64, so as to releasably retain the dorsal shell in substantially planar alignment with the engagement portion 62 of the plantar shell 42. In the illustrated embodiment, the locking feature 65 of the dorsal shell 44 has generally orthogonal engaging surfaces (e.g., horizontal and vertical surfaces) that fit into and securely press against the support surface 70 and the shoulder member 68 when the dorsal shell 42 is in the closed position. In these and other embodiments, the plantar and/or dorsal shells 42, 44 can include one or more registration features, which could be a portion of the locking features 64, 65 or other features configured to aid in positioning the dorsal shell 44 relative to the plantar shell 42. For example, the plantar shell 42 can include a first registration feature, the dorsal shell 44 can include a second registration feature, and the first registration feature can be configured to receive the second registration feature when the dorsal shell 44 is aligned with the plantar shell 42.

Although the locking features 64 and 65 of the embodiment illustrated in FIG. 2C have the shapes as discussed above, other embodiments can have locking features with different mating and/or locking arrangements configured to establish and maintain the interconnection and/or the substantially planar alignment of the planar and dorsal shells 42 and 44 at this dorsal/plantar joint when the dorsal shell is in the closed position. This substantially planar alignment between the plantar and dorsal shells 42 and 44 is configured to efficiently transmit loads or forces between the plantar and dorsal shells 42 and 44 and to or from the wearer's foot.

Figure 2D:
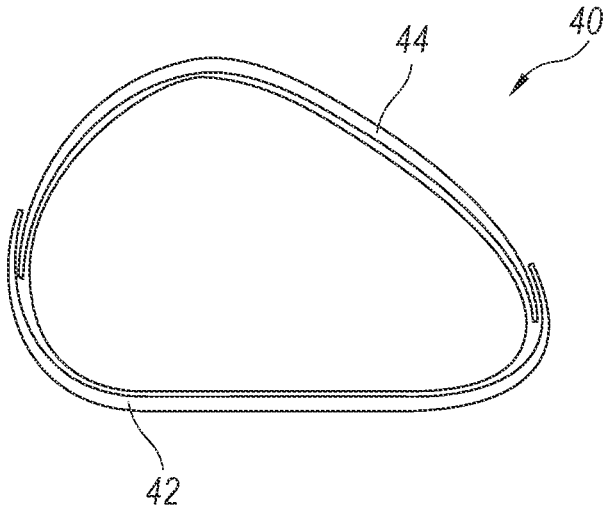
FIGS. 2D-2F are a top plan view and cross-sectional views of other embodiments of the footwear assembly
Figure 2E:
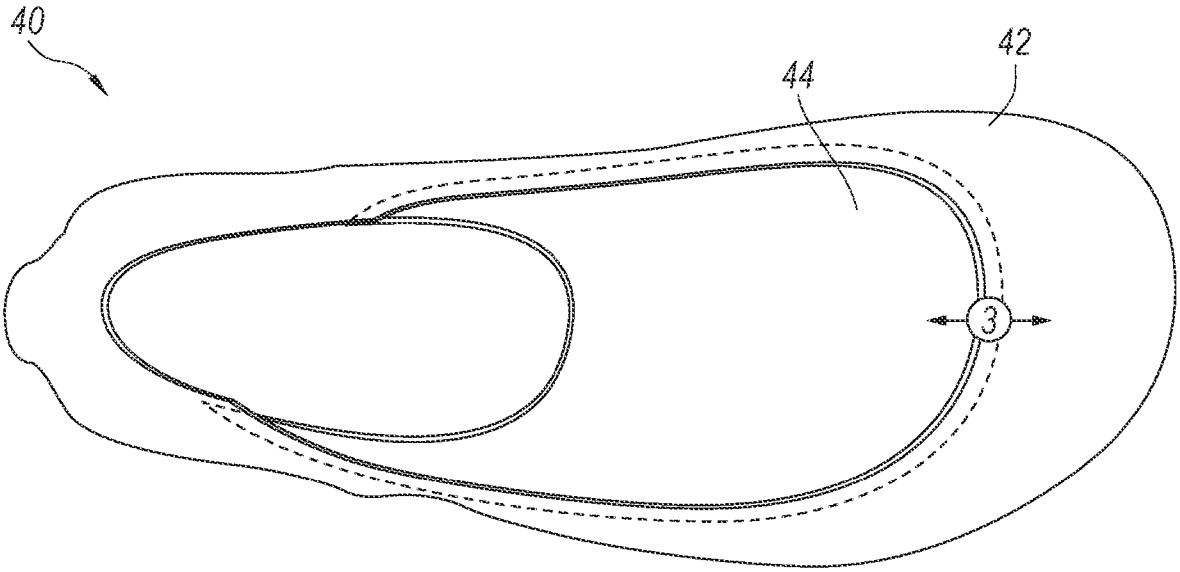

For example, another embodiment illustrated in FIGS. 2D and 2E could have vertical walls on the medial and lateral edges of the plantar shell 42, which the dorsal shell 44 fits into. These vertical walls prevent any motion of the dorsal shell 44 in the medial-lateral direction relative to the plantar shell 42. There is additionally a closure or restraint mechanism that holds the dorsal shell 44 in the downward closed position, applying the load on the user's foot, and constraining the plantar and dorsal shells 42 and 44 together in the vertical direction. There can additionally be constraint between the plantar and dorsal shells 42 and 44 in the fore-aft direction. Therefore, the plantar and dorsal shells 42 and 44 are constrained together in the six degrees of freedom (three translational, three rotational) to effectively act as a monocoque shell and transfer power between the two shells. There can be other examples of locking systems to effectively connect the plantar and dorsal shells 42 and 44 in other embodiments.

Figure 2F:
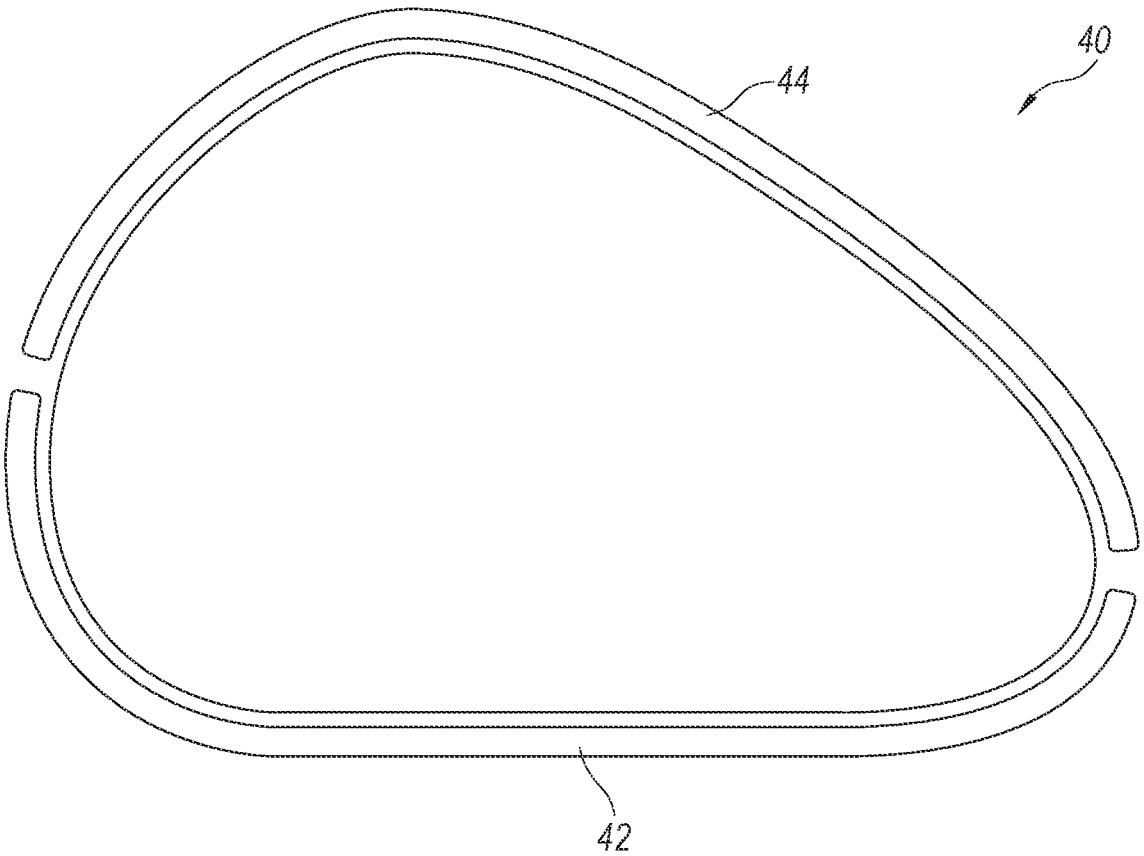

The separation line between the plantar shell 42 and dorsal shell 44 can also be partway up the medial and lateral side walls 52 and 50, as seen in FIG. 2F. This results in the plantar and dorsal shells 42 and 44 being more equal "halves", which comprise a clamshell structure that cups the foot from the bottom and top. All constraining features between the plantar shell 42 and dorsal shell 44 can still apply to this configuration to effectively transfer power between the two shells 42 and 44, but in this configuration a greater percentage of the surface area of the foot is covered by the dorsal shell 42.

The footwear of the illustrated embodiment is 3-D printed using a fiber-reinforced material, such as a printable carbon fiber composite material. The arrangement of the material, including material thickness and reinforcement arrangements, can be precisely controlled to provide a stiff, lightweight, and strong footwear specifically personalized for a wearer based on the 3-D scan of the wearer's foot. In some embodiments, the plantar and dorsal shells 42 and 44 can be made of fiber-reinforced 3-D printing material from Orbital Composites, Inc., although other materials from other sources could be used. In some embodiments, the 3-D scan is obtained using a scanning system from Scandy, LLC, although other 3-D scanners, scanning systems, and/or scanning techniques can be used to obtain the specific data about the foot's shape, size, and contours needed to build the personalized footwear. For example, some embodiments could use a 3-D mold, impression, or layup of the wearer's foot to provide 3-D model data for manufacturing the personalized footwear. Additionally, or alternatively, other imaging techniques, cameras, depth sensors and/or photogrammetry tools can be used to provide the 3-D model data.

Building the personalized plantar shell 42 and the dorsal shell 44 via 3-D printing or one or more other additive or non-additive manufacturing processes to very closely correspond to the wearer's foot allows the footwear assembly 40 to have the caging system 45 with a precise biometric fit to the wearer's foot. This minimizes the excess space around the foot within the caging system 45. As a result, the footwear assembly 40 does not need to sacrifice stiffness for purposes of comfort. Further, the dorsal shell's configuration that pre-compresses the foot's instep portion 22 (FIG. 2C) and that provides the planar alignment with the plantar shell 42, allows for precise and efficient force and load transfer to and from the footwear assembly 40, during activities, including high performance activities.

In some embodiments, the plantar shell 42 and/or the dorsal shell 44 can have an external shell material and a selected inner liner, such as neoprene, a textile material, a non-textile material, a foam/padding, or other liner feature on the inside surface of the associated shell. The footwear assembly 40 can also have a seal 72 or other interface member around the plantar shell's opening 54 or around the dorsal shell's edge portion 66. The seal 72 is positioned to be firmly captured between the plantar and dorsal shells 42 and 44 when the dorsal shell 44 is in the closed position. The seal 72 is configured to facilitate in locating or aligning the dorsal shell 44 with the plantar shell 42 around the opening 54 and to accommodate for any manufacturing tolerances between the components. The seal 72 can be configured to provide a watertight barrier to prevent water and other materials from passing through the joint between the dorsal shell 44 and the plantar shell 42.

The seal can be an elastomeric material compressed between the plantar and dorsal shells 42 and 44, although other materials can be used. The seal 72 also provides a frictional engagement to enhance the interface between the locking features 64 and 65 of the plantar and dorsal shells 42 and 44, thereby preventing relative movement between the plantar shell's engaging portion 62 and the dorsal shell's edge portion 66 when the dorsal shell 44 is in the closed position. Accordingly, when the dorsal shell 44 is in the closed position, the wearer's foot is fully contained and engaged within the caging system 45 of the footwear assembly 40.

Figure 3B:
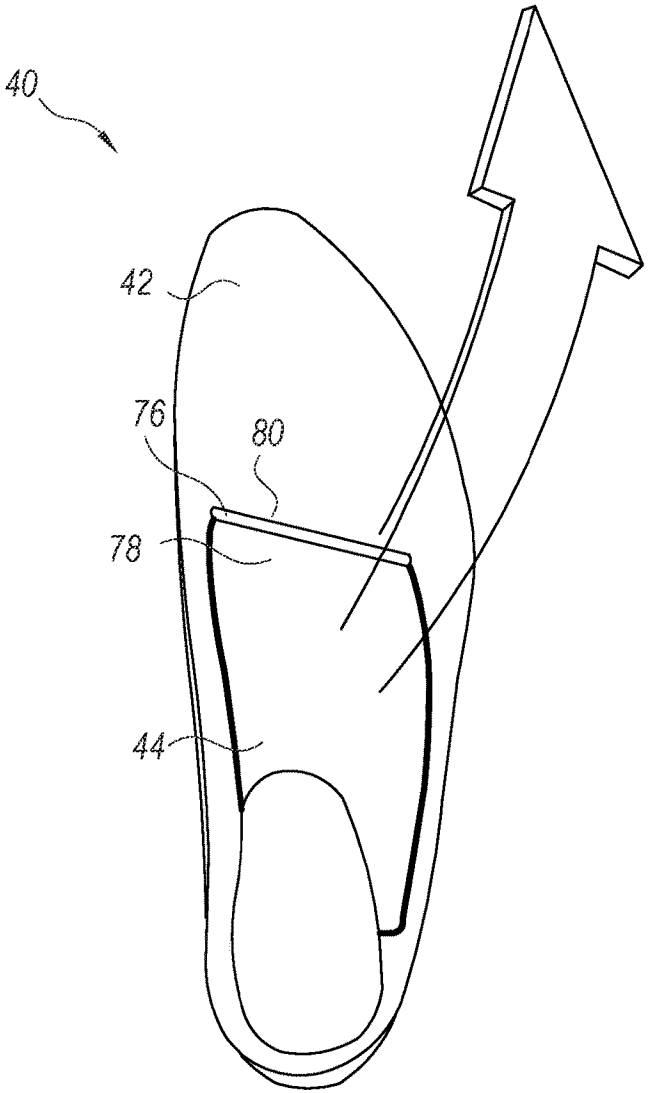
FIGS. 3A and 3B are isometric and top plan views, respectively, of the footwear assembly of FIG. 2A with a front edge portion of a dorsal shell hingedly attached to a plantar shell.
Figure 3A:
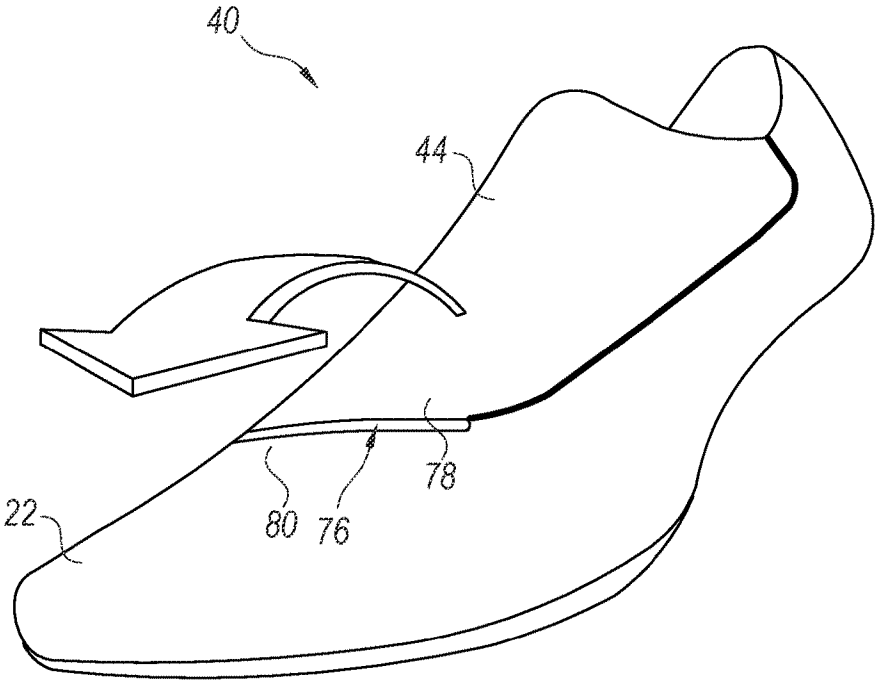

In some embodiments, the dorsal shell 44 can be pivotally attached to the plantar shell 42 to allow for movement of the dorsal shell 44 between the open and closed positions. As seen in FIGS. 3A and 3B, the illustrated footwear assembly 40 has a hinge 76 or other pivoting member coupled to the forward edge portion 78 of the dorsal shell 44 and to the adjacent edge portion 80 of the plantar shell 42 above the foot's forefoot portion 28 (FIG. 1). The hinge 76 may be a living hinge, a pinned hinge, or other hinge mechanism that allows the dorsal shell 44 to move between the open and closed positions.

Figure 4C:
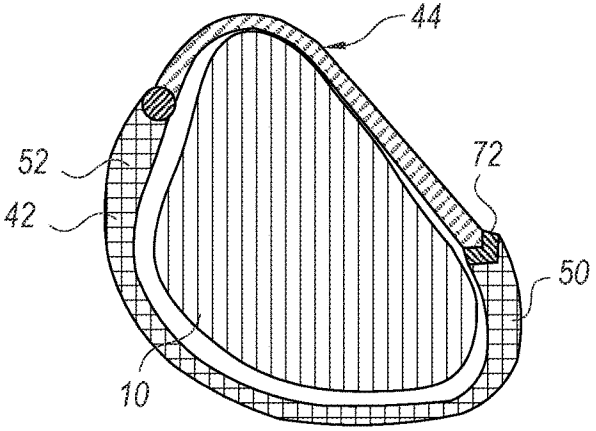
FIG. 4C is a cross-sectional view taken substantially along line 4C-4C of FIG. 4B.
Figure 4B:
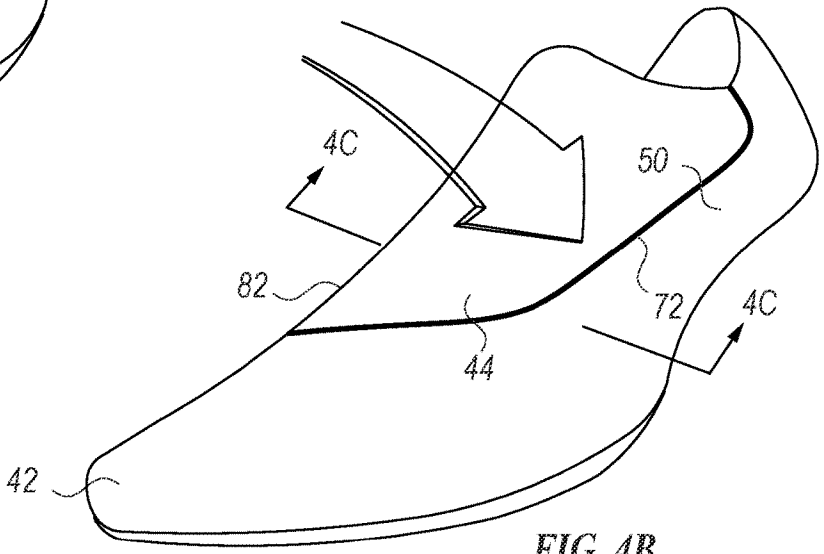
FIG. 4B is an isometric view of the footwear assembly of FIG. 4A with the dorsal shell shown in a closed position.
Figure 4A:
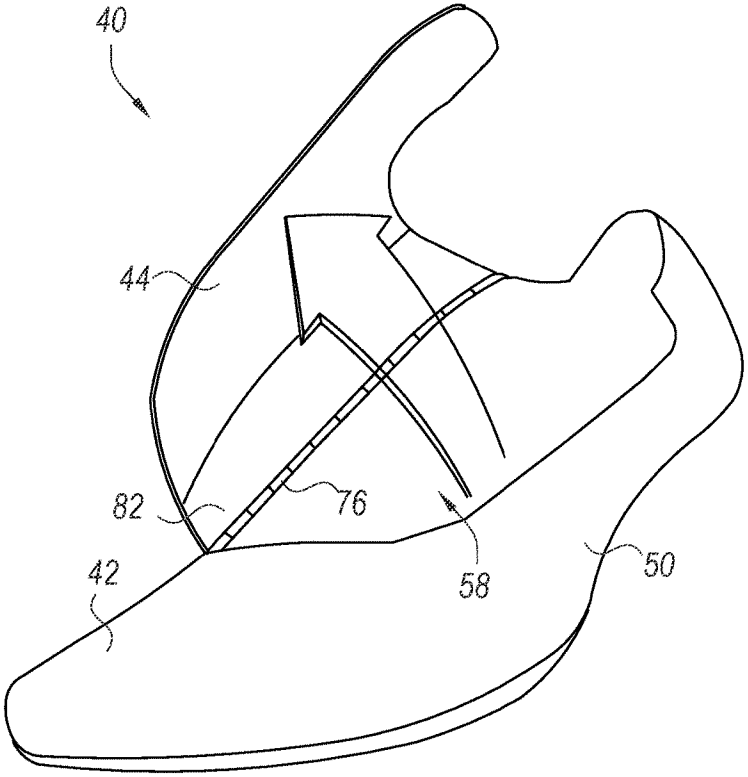
FIG. 4A is an isometric view of the footwear assembly of FIG. 2A with a medial edge portion of the dorsal shell pivotally attached to the plantar shell, and with the dorsal shell shown in an open position.

In another embodiment shown in FIGS. 4A-4C, the hinge 76 can be on the medial side of the footwear assembly 40 and coupled to the plantar shell's medial sidewall 52 and to the medial edge portion 82 of the dorsal shell 44. The hinge 76 can extend along the full length of the dorsal shell's medial edge portion 82, or along only a segment of the medial edge portion 82. Alternatively, the hinge 76 can include two or more spaced apart hinge segments that pivotally interconnect the dorsal shell 44 with the medial sidewall 52 of the plantar shell 42.

Figure 5C:
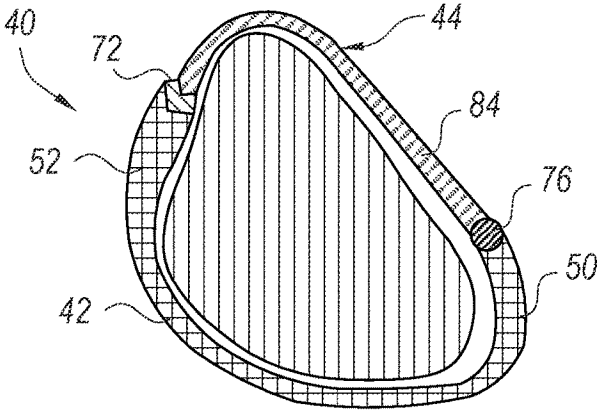
FIG. 5C is a cross-sectional view taken substantially along line 50-5C of FIG. 5B.
Figure 5B:
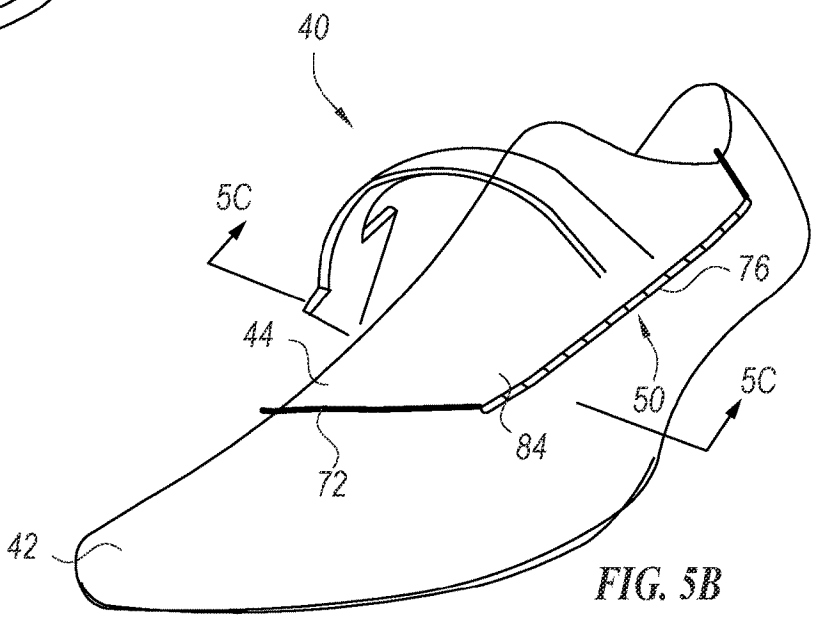
FIG. 5B is an isometric view of the footwear assembly of FIG. 5A with the dorsal shell shown in the closed position.
Figure 5A:
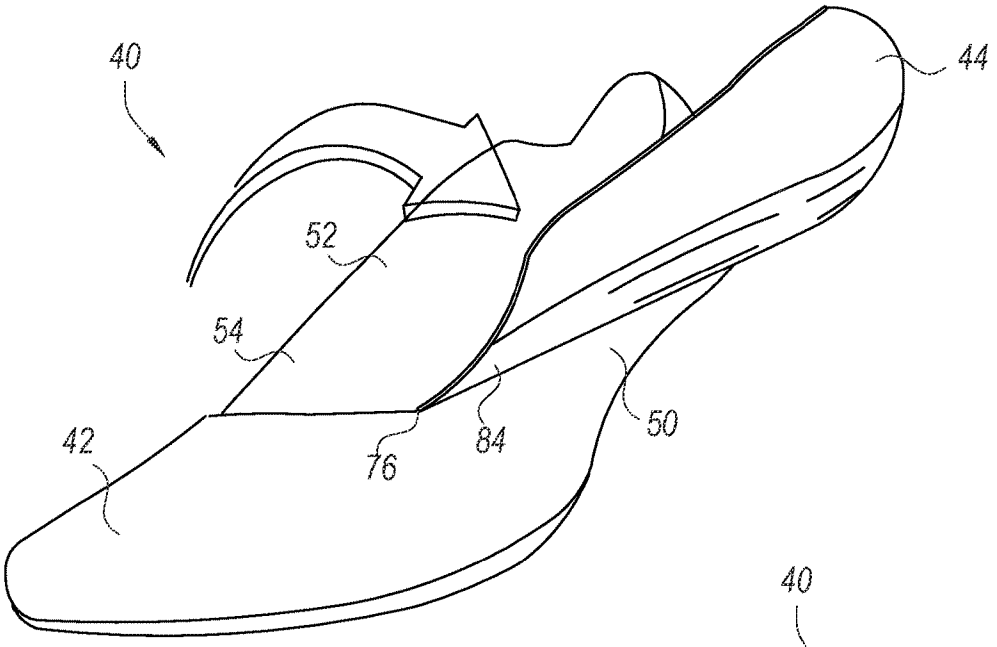
FIG. 5A is an isometric view of the footwear assembly of FIG. 2A with a lateral edge portion of the dorsal shell pivotally attached to the plantar shell, and with the dorsal shell shown in the open position.

In another embodiment shown in FIGS. 5A-5C, the hinge 76 can be on the lateral side of the footwear 40 and coupled to the plantar shell's lateral sidewall 50 and to the lateral edge portion 84 of the dorsal shell 44. The hinge 76 can extend along the full length of the dorsal shell's lateral edge portion 84, or along only a segment of the lateral edge portion 84. Alternatively, the hinge 76 can include two or more spaced apart hinge segments that pivotally interconnect the dorsal shell 44 with the lateral sidewall 50 of the plantar shell 42.

As seen in FIGS. 6A-7B, the footwear assembly 40 has a closure device 88 coupled to the caging system 45 to releasably hold the dorsal shell 44 securely against the plantar shell 42 in the closed position. The closure device 88 is movable between locked and released positions and can be adjustable to control the force with which the dorsal shell 44 is held against the plantar shell 42 and against the foot's instep portion 22 (FIG. 1). When the closure device 88 is in the released position, the dorsal shell 44 can be moved between the closed and opened positions. When the closure device 88 is in the locked position with the dorsal shell 44 in the closed position, the closure device 88 blocks the dorsal shell 44 from moving away from the closed position. Accordingly, the closure devices 88 lock the dorsal shell 44 in firm engagement with the plantar shell 42, so as to form the continuous rigid shell around the wearer's foot 10 in a precise, personalized fit without sacrificing stiffness of the caging system 45.

Figure 6B:
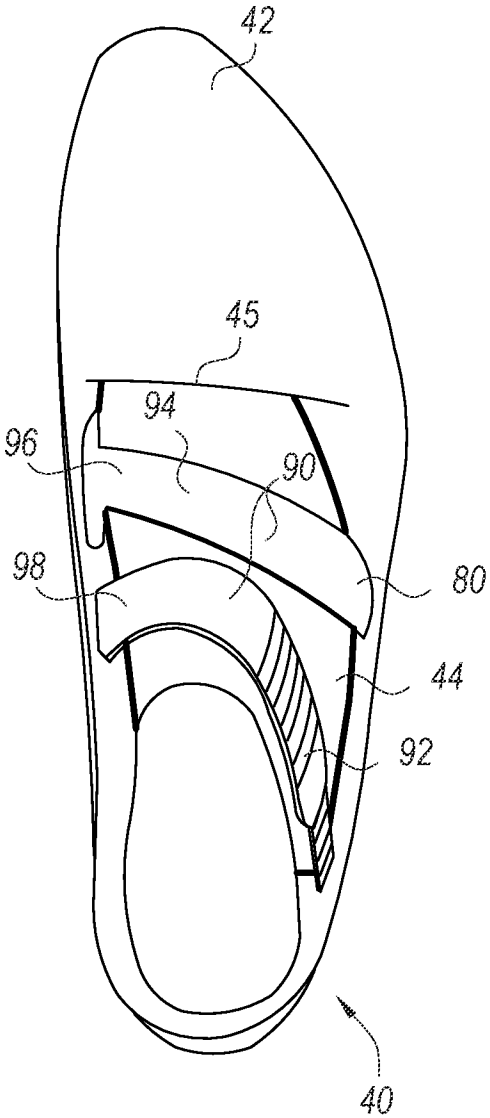
FIGS. 6A and 6B are isometric and top plan views, respectively, of the footwear assembly of FIG. 2A with a closure system comprising one or more buckles and straps.
Figure 6A:
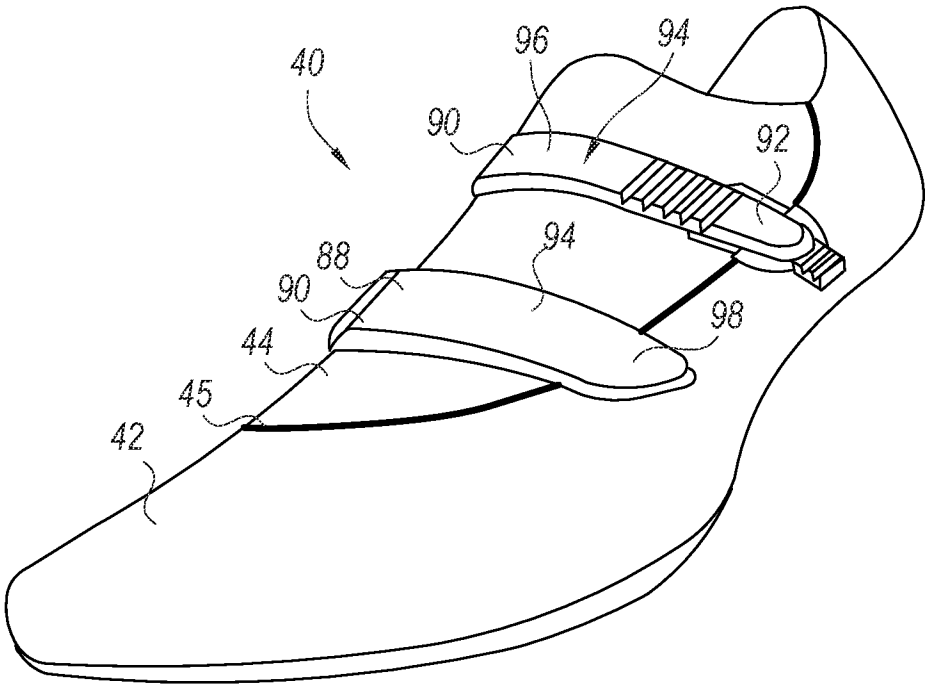

In the embodiment illustrated in FIGS. 6A and 6B, the closure device 88 comprises one or more closable straps 90 anchored to the plantar shell 42, such as along the medial and lateral sidewalls 52 and 50 adjacent to the opening 54. The straps 90 are configured to extend over the dorsal shell 44 when in the closed position. The straps 90 can be retained in the locked position through a buckle feature 92 or other retention mechanisms, such as hook-and-loop material 94 (Velcro®), a ratchet closure system, or other closure mechanisms. The straps 90 can include and/or be formed from one or more fabrics, composites, elastomeric materials (e.g., thermoplastic polyurethane ("TPU") and/or thermoplastic elastomers ("TPE")), and/or other suitable materials. The footwear assembly 40 can include a plurality of closure devices 88, and in other embodiments a single closure device 88 can be used.

A footwear assembly 40 can include multiple closure devices that can be of the same type or can be different types. For example, in the embodiment of FIGS. 6A and 6B, the footwear assembly 40 is a cycling shoe with a rearward strap 96 extending over the dorsal shell 44 above the foot's instep portion 22 (FIG. 1). A forward strap 98 extends over the dorsal shell 44, generally above the forefoot portion 28 (FIG. 1). The rearward strap 96 of the illustrated embodiment includes a buckle feature 92, such as a ratchet buckle system, while the forward strap 98 comprises a hook-and-loop material 94 that releasably holds the forward strap 98 in the locked position.

Figure 7B:
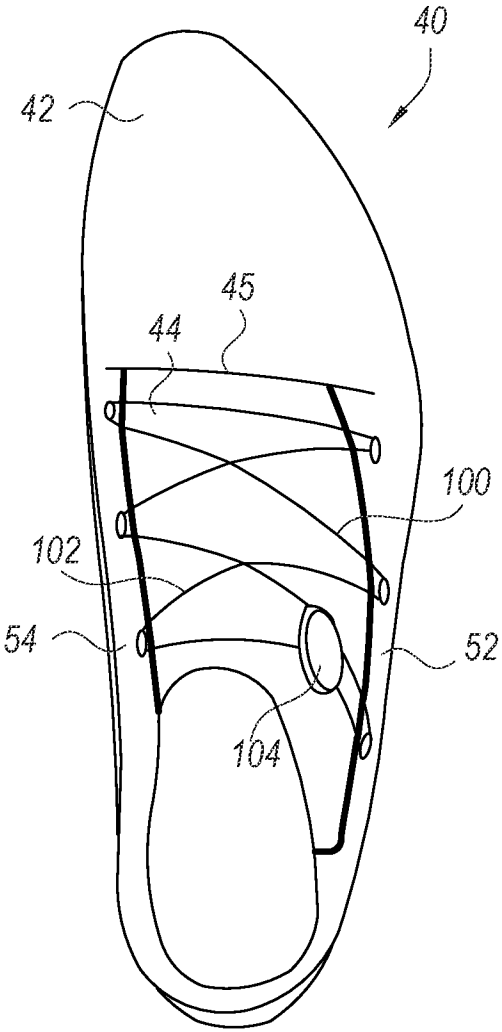
FIGS. 7A and 7B are isometric and top plan views of the footwear assembly of FIG. 1 with a closure system comprising a closure mechanism.
Figure 7A:
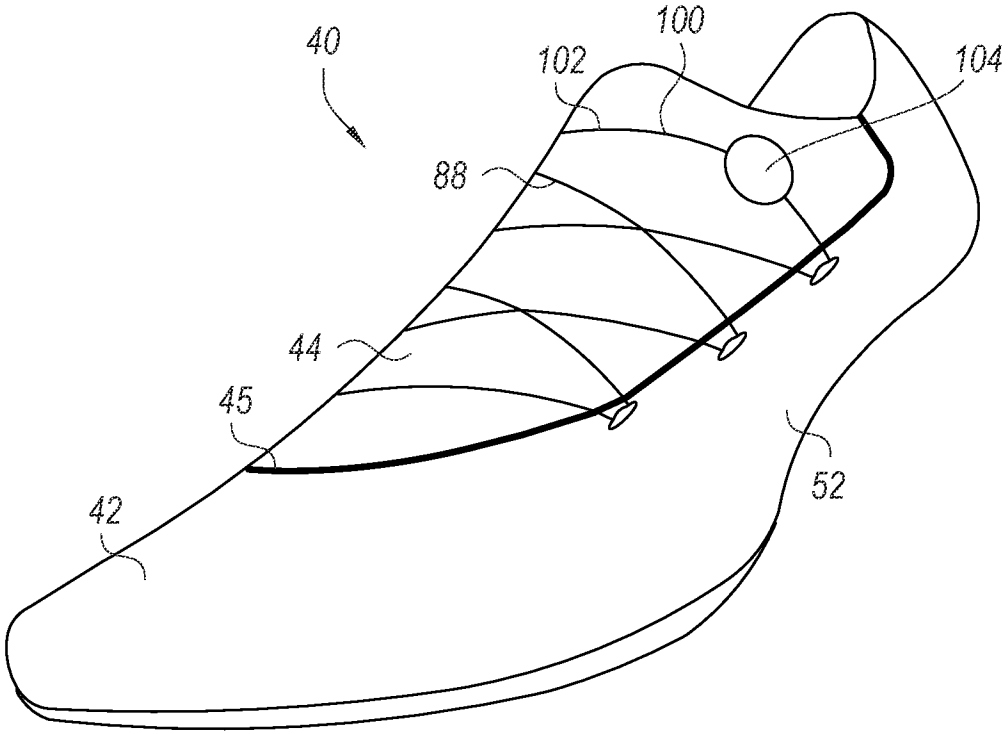
Figure 8B:
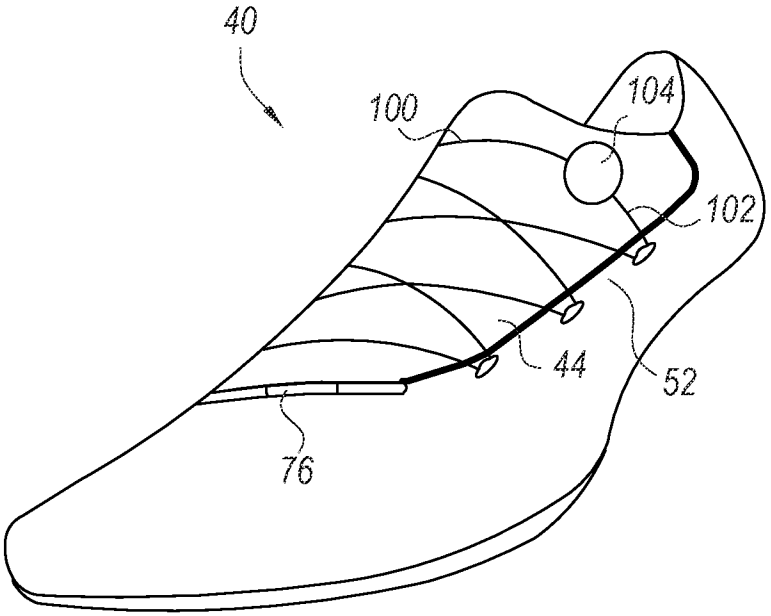
FIG. 8B is an isometric view of the footwear assembly of FIG. 8A with the dorsal shell shown in the closed position.
Figure 8A:
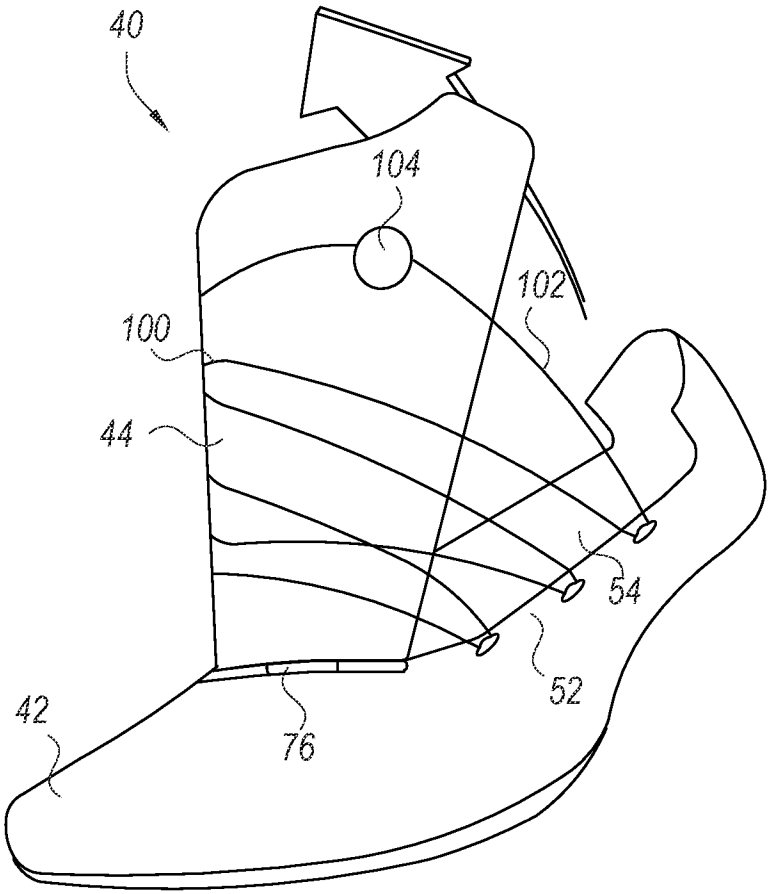
FIG. 8A is an isometric view of the footwear assembly of FIG. 7A with the dorsal shell shown in the open position.

In another embodiment shown in FIGS. 7A-7B, the closure device 88 can be a releasable cable and dial system, such as a closure system provided by Boa Technology Inc., referred to herein as a Boa closure 100. The Boa closure 100 has the cable 102 anchored in a plurality of locations on the medial and lateral sidewalls 52 and 50 of the plantar shell 42. The cable 102 is attached to the adjustment dial 104 configured to tighten or loosen the cable 102 over the dorsal shell 44. As seen in FIG. 8A, when the Boa closure 100 is loosened, the dorsal shell 44 can be moved between the closed and opened positions. When the adjustment dial 104 is activated to tighten the cable 102, as seen in FIG. 8B, the cable 102 tightens over the dorsal shell 44 and locks the dorsal shell 44 in the closed position.

Figure 9C:
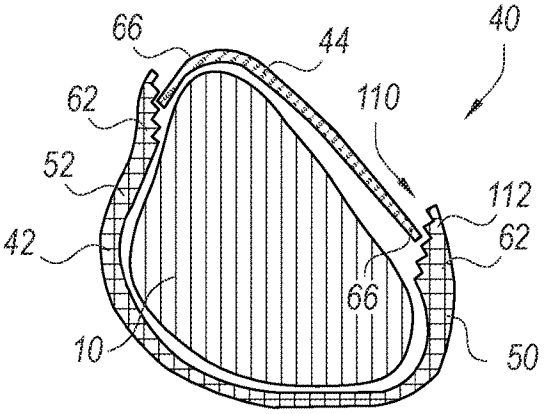
FIG. 9C is a cross-sectional view taken substantially along line 9C-9C of FIG. 9B.
Figure 9B:
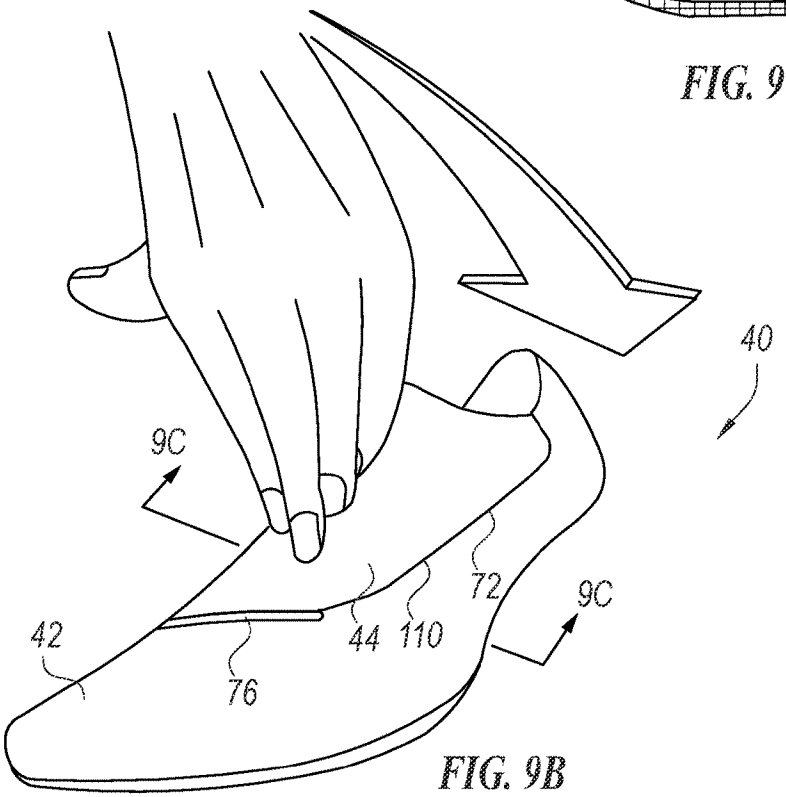
FIGS. 9A and 9B are isometric views of a footwear assembly of the present technology with a quick closure system, and with the dorsal shell shown in the open and closed positions, respectively.
Figure 9A:
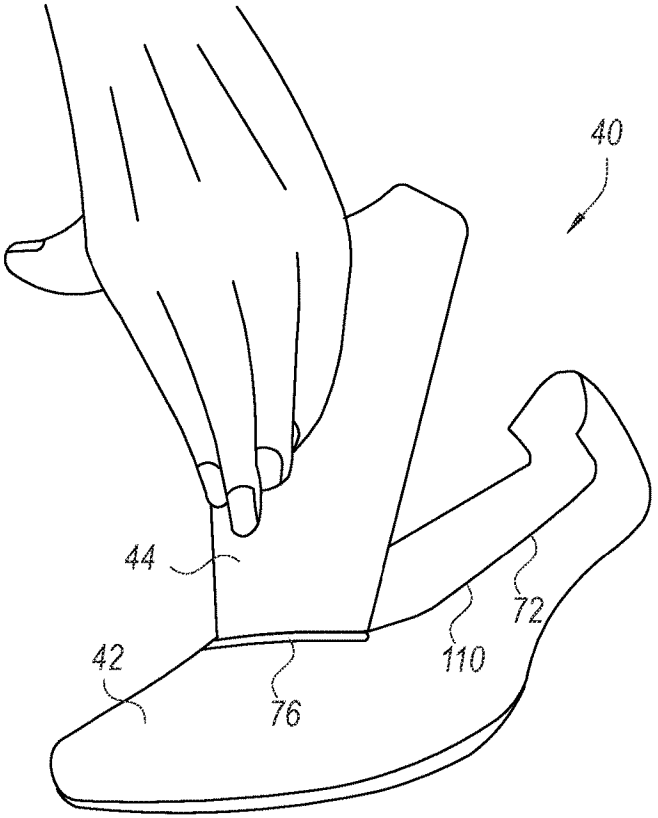

FIGS. 9A and 9B are isometric views of a footwear assembly 40 of another embodiment that has the plantar and dorsal shells 42 and 44 as discussed above and have an integrated quick closure mechanism 110 to releasably hold the dorsal shell 44 in the closed position. The footwear assembly 40 can be, for example, a performance triathlon shoe that allows the wearer to very quickly put on or take off the shoe, while providing the personalized precision fit with the pre-compression of the wearer's instep. The quick closure mechanism 110 can be moved between released and locked positions. In the released position, the quick closure mechanism 110 allows the dorsal shell 44 to move to the open position, so the wearer can insert his or her foot into the plantar shell 42. The dorsal shell 44 can be manually pressed from the open position into the closed position so as to automatically engage and move the quick closure mechanism 110 to the locked position.

As seen in FIG. 9C, an embodiment of the quick closure mechanism 110 can include a series of stepped, ratchet teeth 112 on the plantar shell's engaging portion 62 around some or all of the opening 54. The stepped, ratchet teeth 112 lockably the engage with the edge portion 66 of the dorsal shell 44 to securely hold the dorsal shell in the closed position. In another embodiment, the ratchet teeth 112 configuration can be provided on the dorsal shell 44, rather than the plantar shell 42. The dorsal shell 44 can be manually pressed downward to engage the quick closure mechanism so as to pre-compress the foot's instep portion 22. When the wearer wants to remove the shoe, the perimeter shell's engaging portion 62 can be flexed outwardly so as to disengage the ratchet teeth 112 from the dorsal shell 44. Once the ratchet teeth 112 are disengaged, the dorsal shell 44 can be moved from the closed position to the open position, thereby allowing the wearer to quickly and easily remove his or her foot from the shoe. In other embodiments, other integrated quick closure mechanisms can be used for quick locking and releasing of the dorsal shell 44 from the plantar shell 42.

The closure systems illustrated in FIGS. 6A-9C are only examples of some of the closure systems that can be used in the present technology. Other embodiments can include one or more closure mechanisms coupled to the caging system 45 to releasably hold the dorsal shell 44 securely in position relative to the plantar shell 42 in the closed position and that can be adjustable to control the force with which the dorsal shell 44 is held against the plantar shell 42 and/or against the foot's instep portion 22 (FIG. 1). Other examples of closure systems could include webbings, textile straps, buckles typically used in ski boots, cables, etc. In other embodiments, the dorsal shell 44 can be configured to engage with the plantar shell 42 and move between the open and closed positions without the use of a hinge. For example, the plantar or dorsal shell 42 or 44 can use a rail, post, or other alignment system for movement and interface between the plantar and dorsal shells, which may or may not have a hinged connection between them.

Figure 10A:
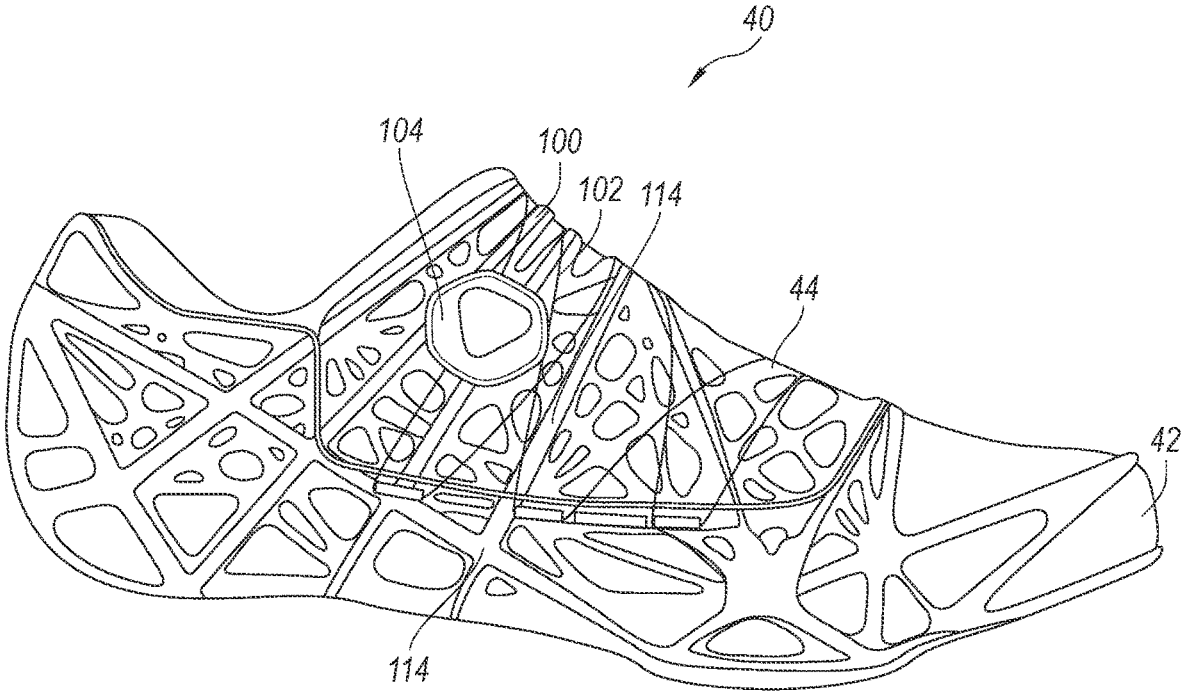
FIG. 10A is a side view of a cycling shoe in accordance with another embodiment of the present technology.

FIG. 10A is a side view of footwear assembly 40 in accordance with another embodiment of the present technology. In this embodiment, the illustrated footwear assembly is a cycling shoe with the plantar and dorsal shells 42 and 44 as discussed above. The illustrated closure device 88 is a Boa closure 100, although other closure devices could be used. The plantar shell 42 and dorsal shell 44 are manufactured with a 3-D printing or other additive or non-additive manufacturing technology using a fiber-reinforced, high-strength polymer. The plantar and dorsal shells 42 and 44 each have a plurality of integral reinforcement ribs 114 positioned and oriented at selected areas to control the force distribution and load paths in the shoe. Reinforcement ribs 114 of the plantar shell 42 in the illustrated embodiment can align with the reinforcement ribs 114 of the dorsal shell 44 when in the closed position, thereby providing precise load distribution between the plantar and dorsal shells 42 and 44. The reinforcement ribs 114 can be provided in areas of the shoe at selected orientations, thicknesses, and lengths so as to selectively direct the forces through the shoe during use. As a result, other areas of the plantar and/or dorsal shells 42 and 44 can have a reduced thickness and can be manufactured with less material. This construction provides for a personalized shoe with a precision fit and that is stiff and strong, yet extremely lightweight.

Figure 10B:
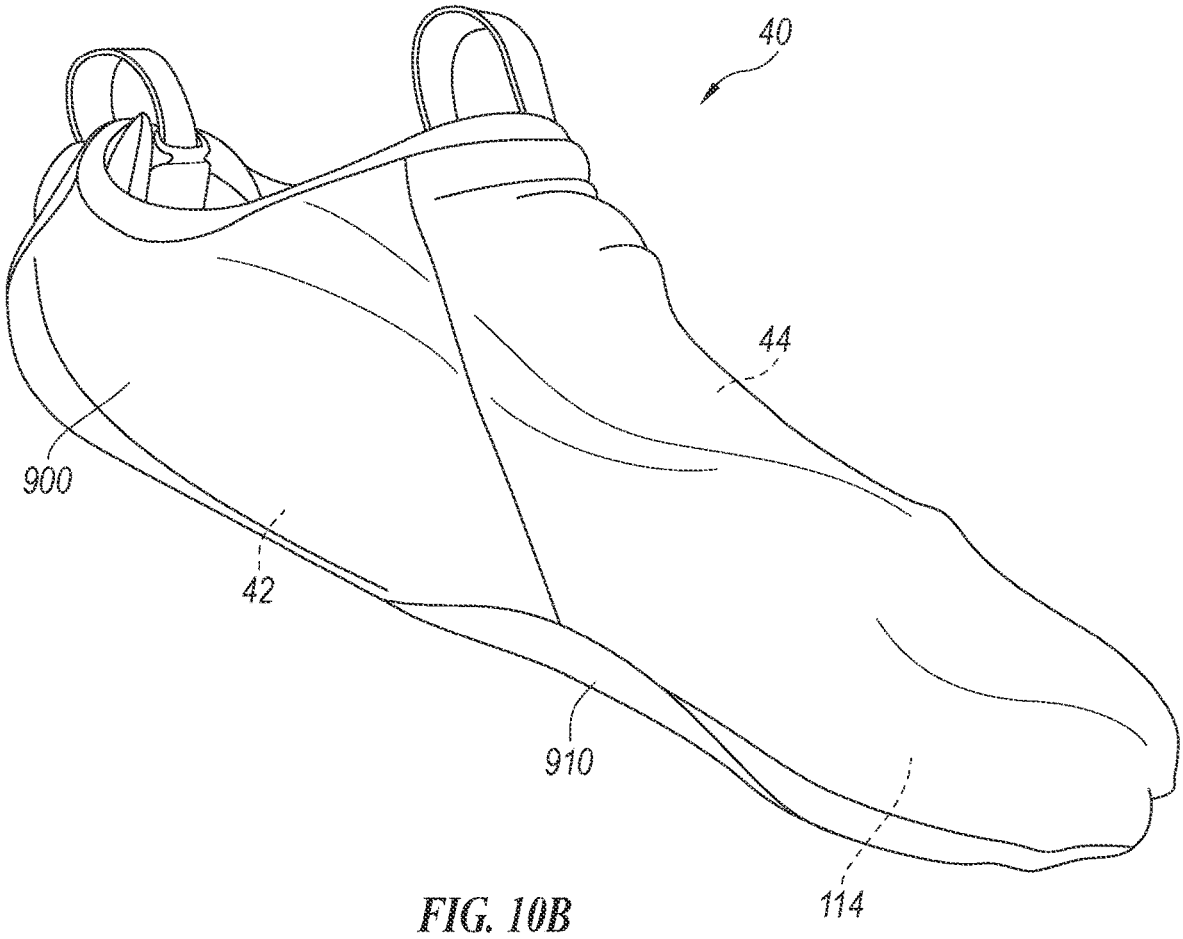
FIGS. 10B and 10C are isometric views of a shoe, such as a cycling shoe, in accordance with another embodiment of the present technology.
Figure 10C:
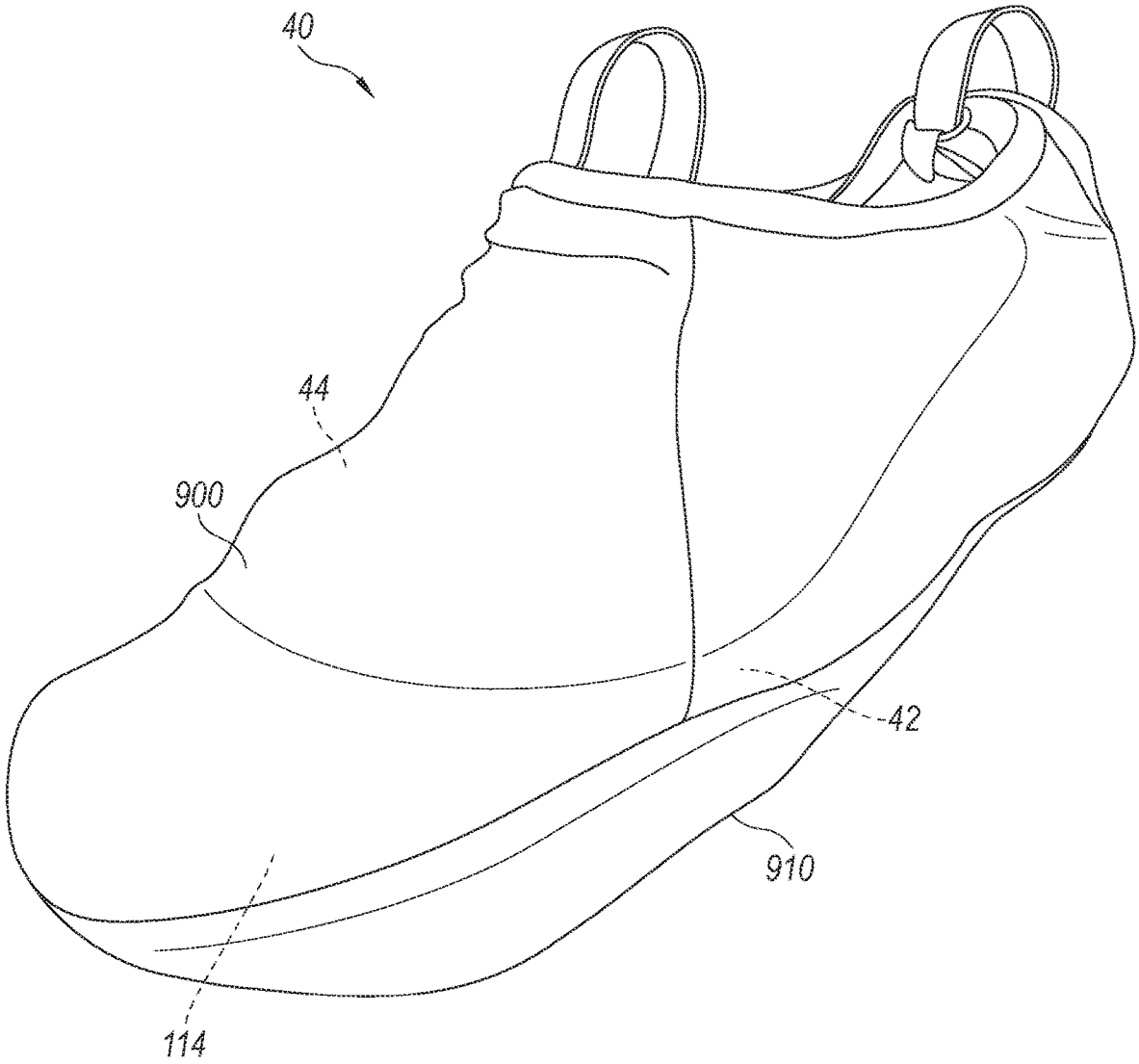
Figure 10D:
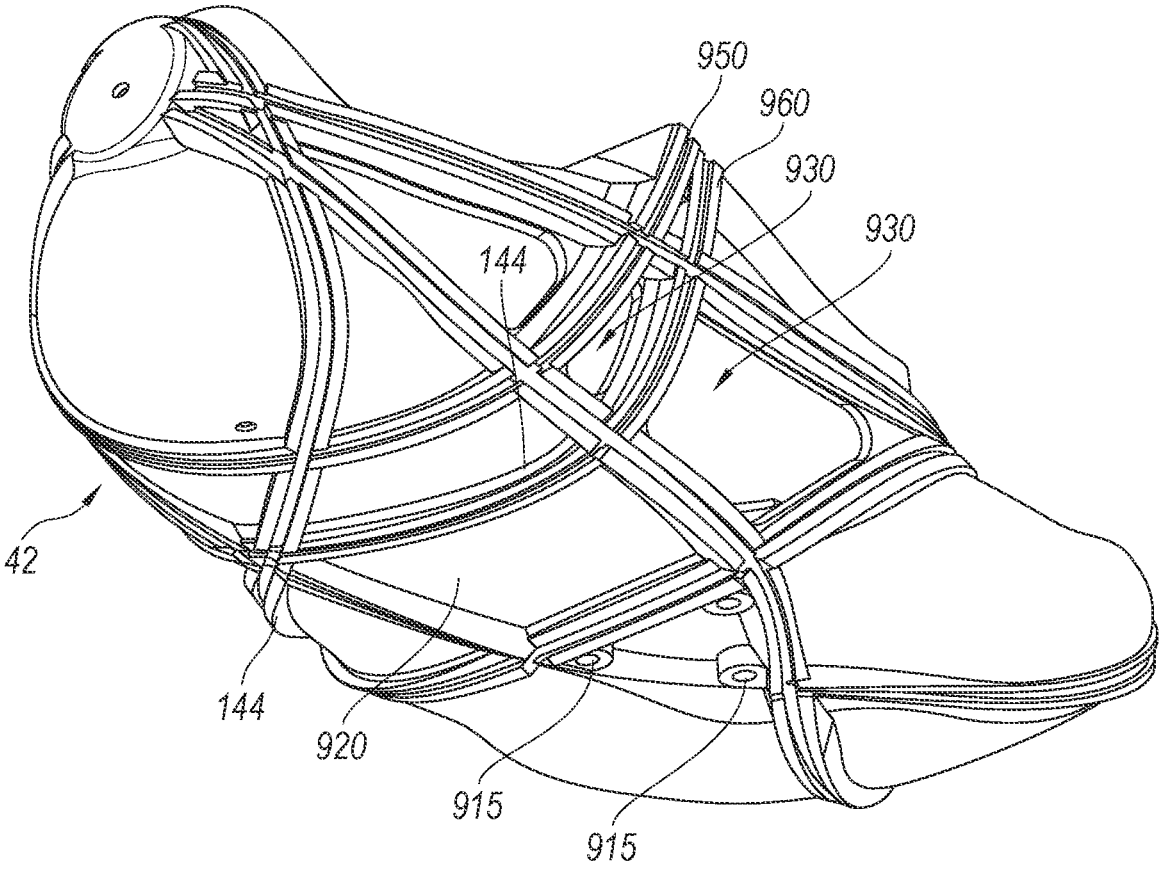
FIG. 10D is a rear isometric view of a plantar shell of the shoe of FIGS. 10B & 10C, wherein an outer cover layer is removed to illustrate the plantar shell with reinforcing ribs or struts.
Figure 10E:
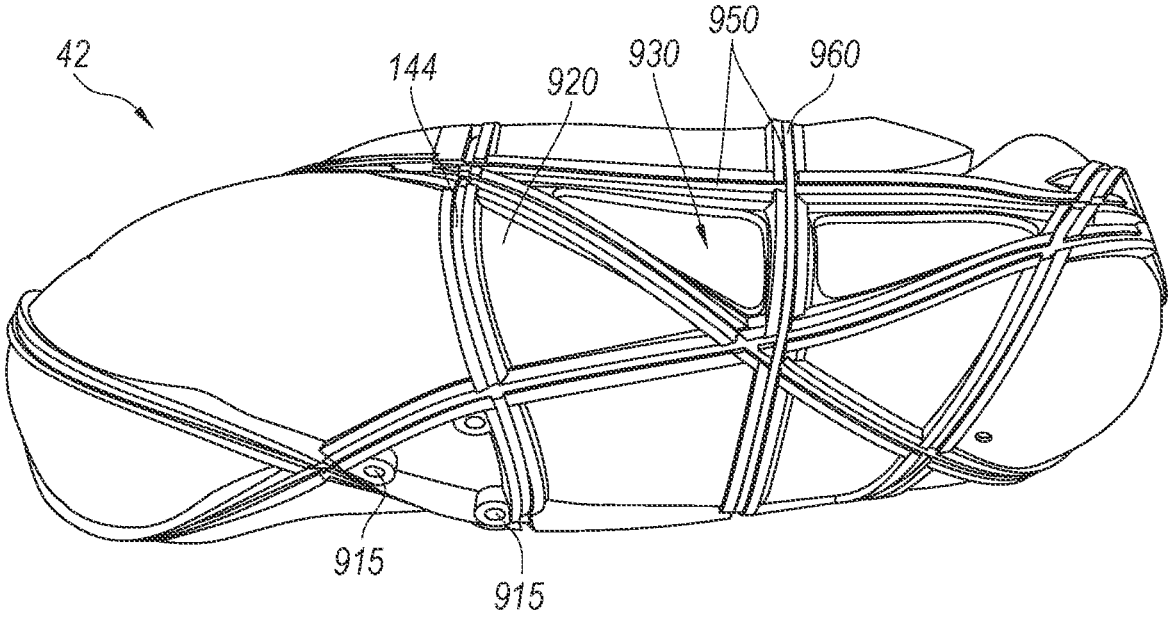
FIGS. 10E-10G are bottom isometric views of the plantar shell of FIG. 10D.
Figure 10F:
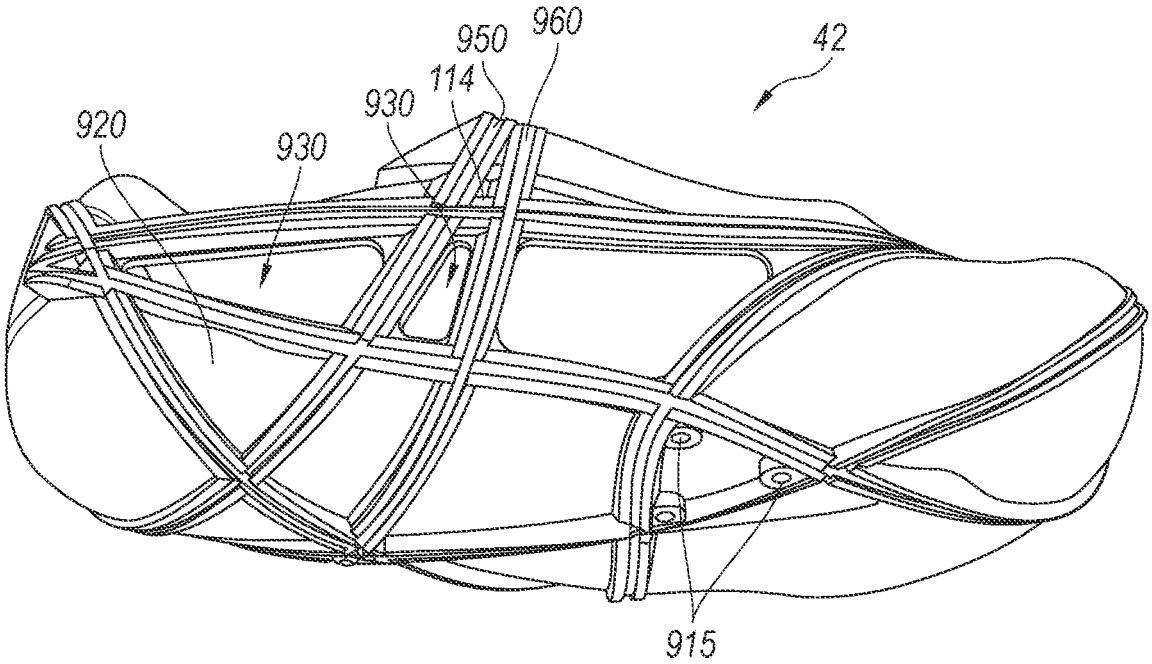
Figure 10G:
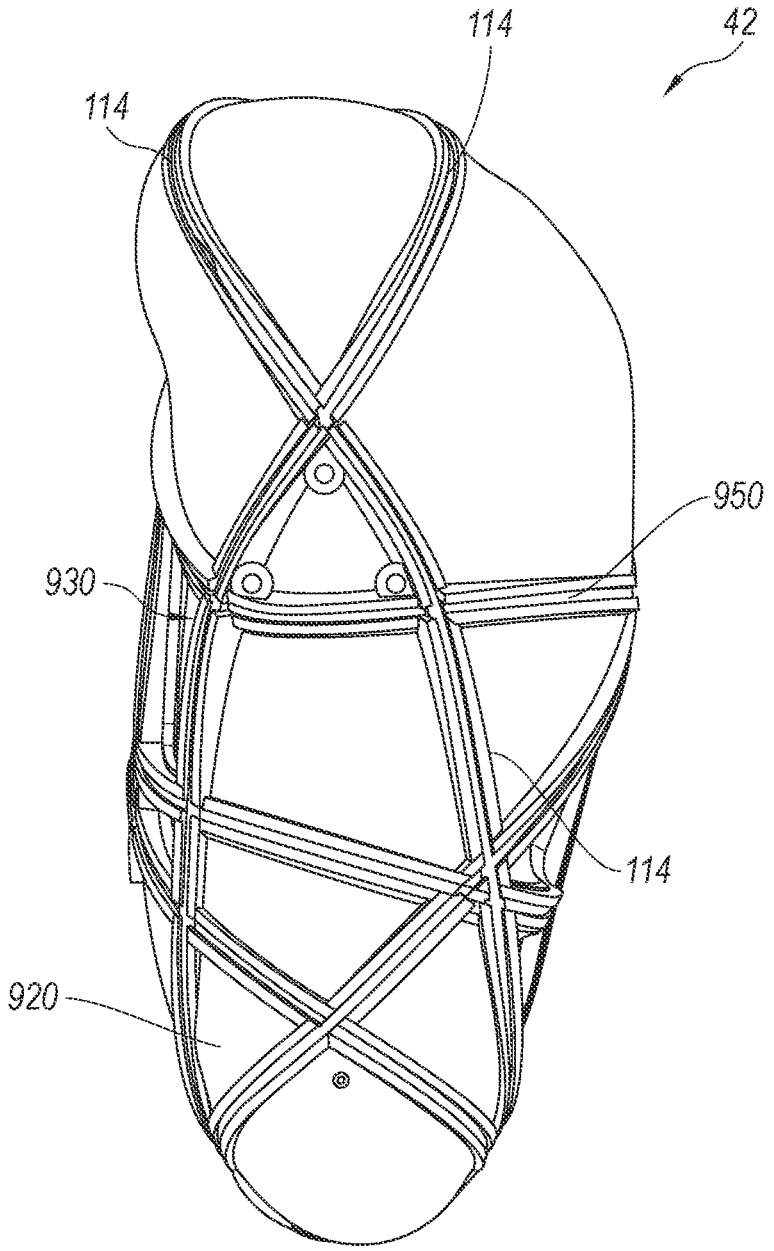

FIGS. 10B and 10C are isometric views of a footwear assembly 40, shown as a cycling shoe, with a flexible outer cover 900 over the plantar shell 42 and dorsal shell 44. In the illustrated embodiment, the outer cover 900 is a fabric or textile cover removably positioned to cover and substantially enclose the plantar and dorsal shells 42 and 44. The cover 900 can be an insulative material, such as a neoprene material or the like. In other embodiments, the cover 900 can be a waterproof or water-resistant material. The flexible cover 900 on the cycle shoe has an opening 910 on the bottom side that exposes the cleat assembly attached to the bottom of the plantar shell 42. The opening 910 also allows access to the mounting holes 915 in the bottom of the plantar shell 42 that receive the fasteners of the cleat assembly while the cover 900 is installed. This allows the cleat assembly to be adjusted or changed without having to remove the outer cover 900 from the rest of the shoe.

FIGS. 10D-10G are isometric views of the plantar shell 42 of the footwear 40 of FIGS. 10B and 10C. The plantar shell 42 of the illustrated embodiment is formed with a plurality of reinforcement ribs 114 extending along selected portions of the shell. The precise positioning and location of the ribs 114 is based on the 3-D scan or other shape information about the wearer's foot, as discussed above, so as to avoid uncomfortable pressure points on the wearer's foot during use. The ribs 114 are also positioned to provide the stiffness and force reaction structures at portions of the plantar shell 42 for efficient force transfer while maintaining comfort for the wearer's foot while cycling or other use. The dorsal shell 44 (not shown) can have similar reinforcement ribs 114 aligned and mating with ribs 114 on the plantar shell 42 to facilitate force and load transfer across the connection between the plantar and dorsal shells 42 and 44. The dorsal shell 44 in other embodiments could have independent reinforcement ribs that do not line up with the reinforcement ribs on the plantar shell 42.

The area between the reinforcement ribs 114 can be formed by a very thin material forming a web 920 between the ribs, such that the ribs 114 extend outwardly and stand proud from the web material. In some embodiments, such as when the shoe or a portion thereof is made using an additive manufacturing process, a thin seed layer is formed based on the shape information for the particular wearer's foot, and the ribs 114 are formed atop and extend from the seed layer, so the ribs extend and stand proud from the seed layer. Accordingly, the seed layer material between the ribs 114 forms with thin webs 920 between the ribs 114. In other embodiments, the seed layer can be formed by another manufacturing process, such as a vacuum molding or injection molding process and the ribs 114 are formed atop the seed layer.

Some or all of the areas between the reinforcement ribs 114 can be free of material, so the plantar shell 42 and/or the dorsal shell 44 has open holes 930 between the ribs 114. In the embodiment wherein a seed layer is formed and the ribs 114 are formed atop the seed layer, the seed layer can be formed with the holes 930 in locations corresponding to areas between the ribs 114. The construction with the holes 930 between the ribs 114 results in a very lightweight shoe that is shaped and sized to the individual wearer's foot without sacrificing the comfort, stiffness, and force transfer abilities of the shoe. In yet other embodiments, the plantar shell 42 and/or the dorsal shell 44 can be constructed without any web material 920 between the ribs, so all of the spaces between the ribs 114 are open. Accordingly, the plantar shell 42 and/or the dorsal shell 44 is formed by the interconnected ribs 114 that provide a customized exoskeleton around the wearer's foot.

In the illustrated embodiment seen in FIGS. 10D-10G, the ribs 114 are constructed with one or more alignment channels 950 in the outer surface that would be facing away from the wearer's foot. The alignment channels 950 are configured to receive and contain reinforcement fiber material 960, such as carbon fiber materials. In the figures, the reinforcement fibers 960 are shown in only some of the channels 950 for illustrative purposes, and other channels are illustrated without the fibers therein. It is understood that all of the alignment channels 950 in all of the ribs 114 can be filled with the fiber material. In other embodiments, the reinforcement fibers 960 may only be in the channels or portions of the channels in some of the ribs 114, such as in selected areas where additional strength and/or stiffness may be desired.

The reinforcement fibers 960 can be laid into the channels 950 along with a matrix material that permanently and structurally affixes to the ribs, so that the reinforcing fibers work with the ribs 114 to maintain the stiffness of the plantar shell 42 and/or the dorsal shell 44. In some embodiments, the ribs 114 can have a central channel 950 formed in the outer surface, although other embodiments can have two or more channels 950 formed in the rib's outer surface.

The reinforcement fibers 960 and associated carrier matrix, such as an epoxy or other suitable polymer material, can be laid into the channels 950 of the reinforcement ribs 114 by an additive manufacturing or other suitable manufacturing process. The ribs 114 or the channels 950 can be constructed to facilitate the installation or laying in of the reinforcement fibers 960 by forming the ribs 114 so the outer surface of each rib is only convex or flat in the rib's axial direction. Accordingly, the ribs 114 do not have concave areas in the axial direction. This convex configuration of the ribs 114 and associated channels 950 allows the reinforcement fibers 960 to better maintain axial alignment and engagement within the ribs 114 when the fibers 960 are laid into the channels 950. The reinforcement fibers 960 and/or ribs 114 are preferably long sections, in order to distribute forces over greater distances. Conversely, short sections of reinforcement fibers are less effective. Preferably the length of reinforcement fibers 960 and/or ribs 114 are greater than 1" long, more preferably the length is greater than 2", more preferably the length is greater than 4", and more preferably the length is greater than 6". It is also beneficial for the reinforcement fibers 960 and/or ribs 114 to be continuously connected around the footwear, so that one path connects to another and can be created in a continuous motion.

Alternatively, the fiber reinforcement and carrier matrix can be deposited directly onto a mold surface, without the use of any alignment channels. In this case, the mold is removed after forming, and only the composite ribs are remaining.

It is beneficial to add the composite material just along the paths of the reinforcement ribs 114, instead of traditional composite techniques that start with sheets of woven fiber material. Using traditional composite layup techniques, the composite material is added to entire surfaces of the structure, and weight reduction is achieved through post-cutting holes or layups using many pieces which require extra fabrication time. It is preferable, therefore, to place the composite material only along the reinforcement rib paths, which uses less material, reduces weight, cost, and manufacturing time, while still obtaining the benefits of composite materials exactly where they are desired on the plantar shell 42 and/or dorsal shell 44.

Figure 11A:
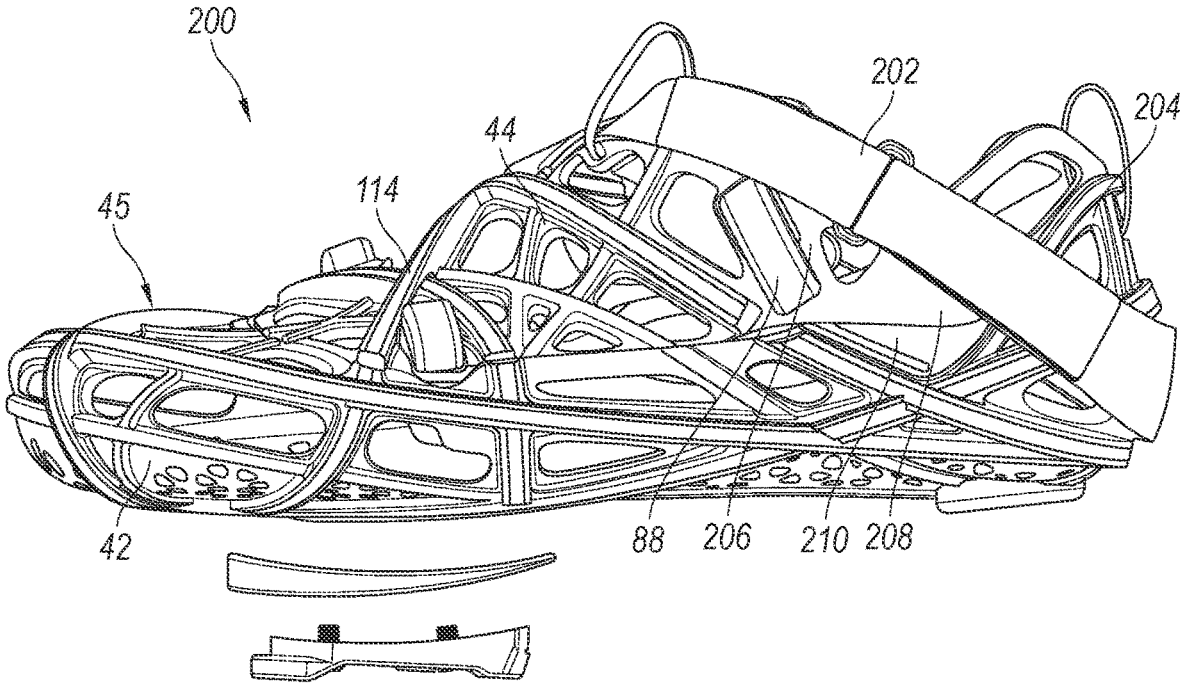
FIGS. 11A and 11B are side and isometric views of a shoe assembly in accordance with an embodiment of the present technology.
Figure 11B:
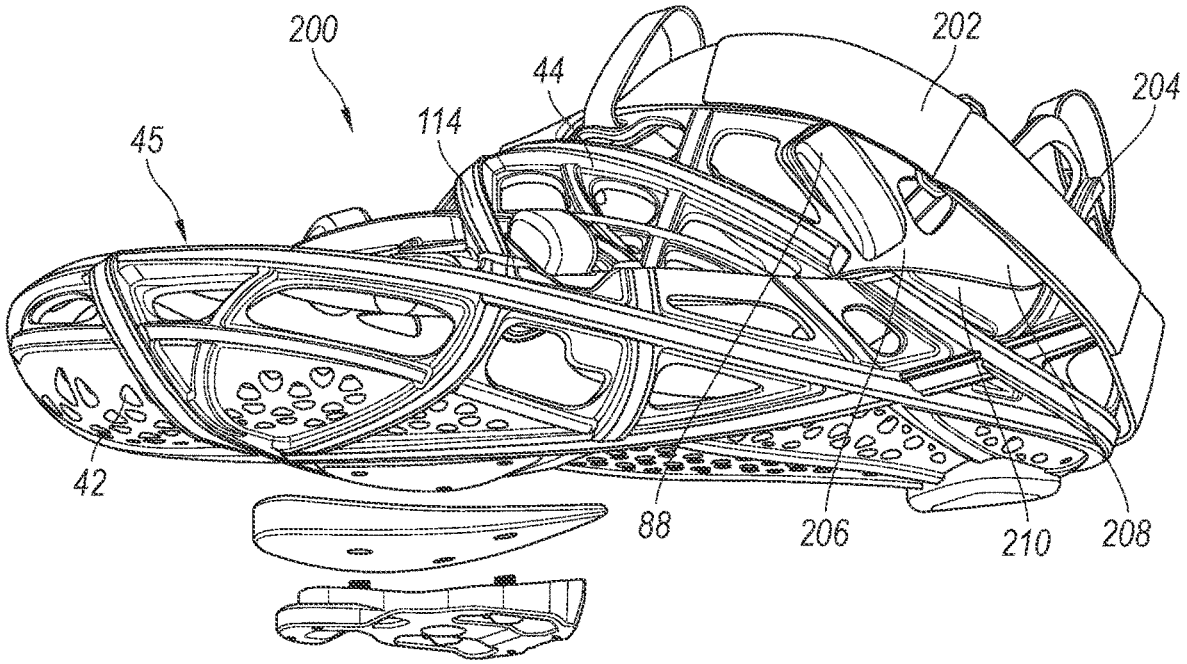

FIGS. 11A and 11B are side and isometric views of a cycling shoe assembly 200 in accordance with one or more embodiments of the present technology. The cycling shoe assembly 200 can include at least some features that are generally similar or identical in structure and/or function to one or more of the footwear assemblies 40 of FIGS. 2A-10G. Accordingly, like names and/or reference numbers (e.g., plantar shell 42) indicated generally similar or identical aspects. Additionally, in at least some embodiments, the shoe assembly 200 can include one or more features from any of the footwear assemblies 40 described herein. The illustrated shoe assembly 200 is configured to support the wearer's foot in or toward a neutral position during a 360-degree pedal cycle. The illustrated shoe assembly 200 has the personalized plantar and dorsal shells 42 and 44 precisely fit for a particular wearer's foot 10 (FIG. 1) to provide the caging system 45 with the reinforcement ribs 114 as discussed above. When the shoe assembly 200 is constructed, it is typically built based on a scan or other information about the wearer's foot while the foot is in a neutral and substantially unloaded condition, as previously described herein (e.g., FIGS. 2A-2F). In use during a 360-degree pedal cycle, the wearer's foot, ankle, lower leg, and shoe assembly 200 are typically subjected to compression loads, shear loads, and torsional loads, particularly when the wearer is actively pushing downwardly on the pedal during the power portion of the pedal cycle. These loads can result in pronation, supination, and/or other alignment changes in the wearer's foot away from the neutral position, such as during one or more pedal cycles and/or pedal strokes. The shoe assembly 200 helps maintain the neutral alignment of the foot during the pedal stroke, for example, by inhibiting or prevent pronation, supination, and/or other alignment changes of the wearer's foot.

In the illustrated embodiment, the dorsal shell 44 of the shoe assembly 200 is securely retained in the closed position on the plantar shell 42 as discussed above by a plurality of closure devices 88, such as straps, ratchet, buckles, laces, cable and/or dial systems, etc. as discussed above. In addition, the shoe assembly 200 of the illustrated embodiment has an adjustable strap 202 anchored to the heel portion 204 of the plantar shell and wraps over the top of the dorsal shell 44. The strap 202 extends over the medial and lateral sides of the dorsal shell 44 along its posterior edge portion and also along the medial and lateral sides of the plantar shell 42 at the heel portion and below or otherwise adjacent to the wearer's ankle. The strap 202 is adjustable and can be tightened or loosened to help control medial and lateral flex of the plantar and dorsal shells 42 and 44 adjacent to the wearer's lateral malleolus and adjacent to the strap 202. Accordingly, the strap 202 provides support along the sides of the shoe assembly 200 to help block the wearer's foot from moving away from the neutral alignment, particularly while the user is pushing hard against the pedal during the downward phase of the pedal cycle.

The strap 202 also helps hold the wearer's heel in the shoe's heel pocket (e.g., the heel portion 204), as well as helping to direct loads (i.e., rotational loads, sheer loads, and/or compression loads) from the wearer's lower leg, ankle, and foot into the shoe's rigid cage system 45 and to the pedal for efficient power transfer during the pedal cycle. For example, the strap 202 can press at least a portion of the dorsal shell 44 against the instep portion 22 of the wearer's foot to thereby drive the heel portion 18 (FIG. 1) of the wearer's foot (e.g., the calcaneus bone) toward and/or into the heel portion 204 of the shoe assembly 200. The strap 202 can be configured to maintain or hold the heel portion 18 in substantially constant contact with the heel portion 204 throughout a pedal stroke, such during at least part of an upstroke portion of the pedal stroke. Maintaining or holding the heel portion 18 in contact with the heel portion 204 for an upstroke portion or recovery phase of the pedal stroke can increase (e.g., maximize) force and/or power transfer from the wearer's foot and/or leg to a bicycle pedal during at least this portion of the pedal cycle. In these and other embodiments, the shoe assembly 200 can include one or more other closure devices 88 (e.g., cables, buckles, snaps, laces, and/or the like) configured at least generally similar or identical in structure and/or function to the strap 202.

Figure 12:
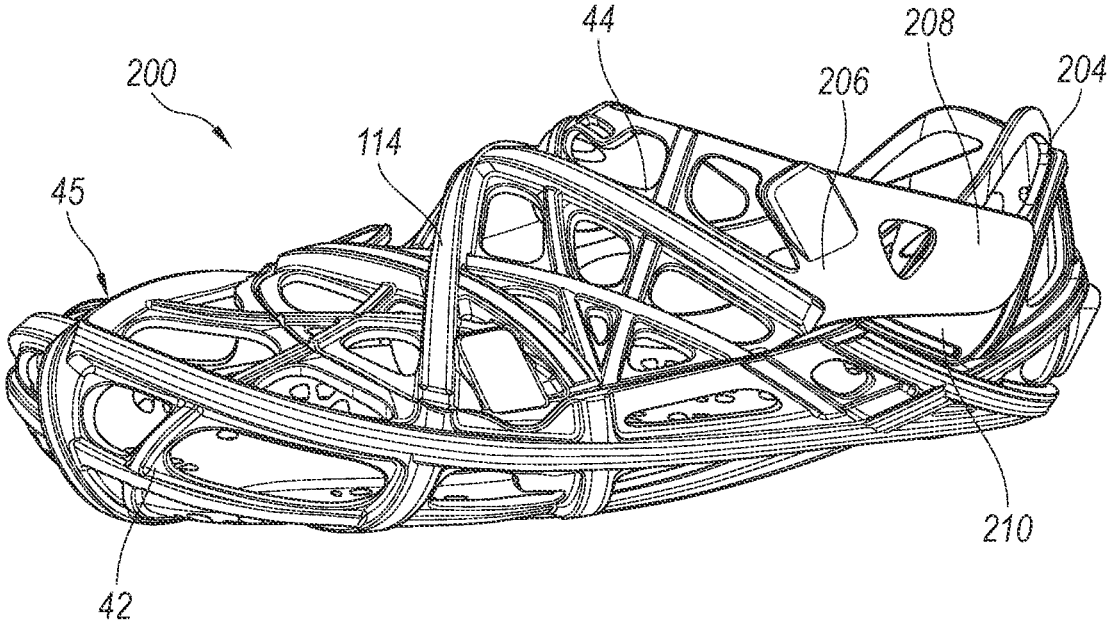
FIG. 12 is a side view of the plantar and dorsal shells of the shoe assembly of FIG. 11A.
Figure 13:
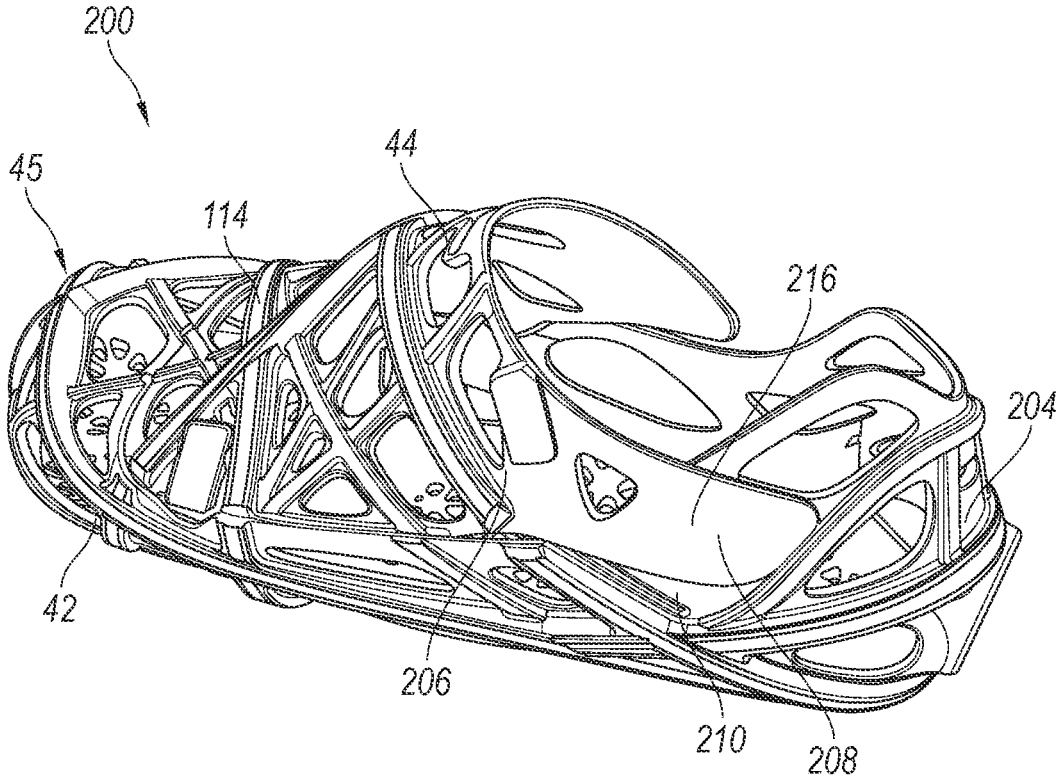
FIG. 13 is a top, rear isometric view of the shoe assembly of FIG. 12.
Figure 14:
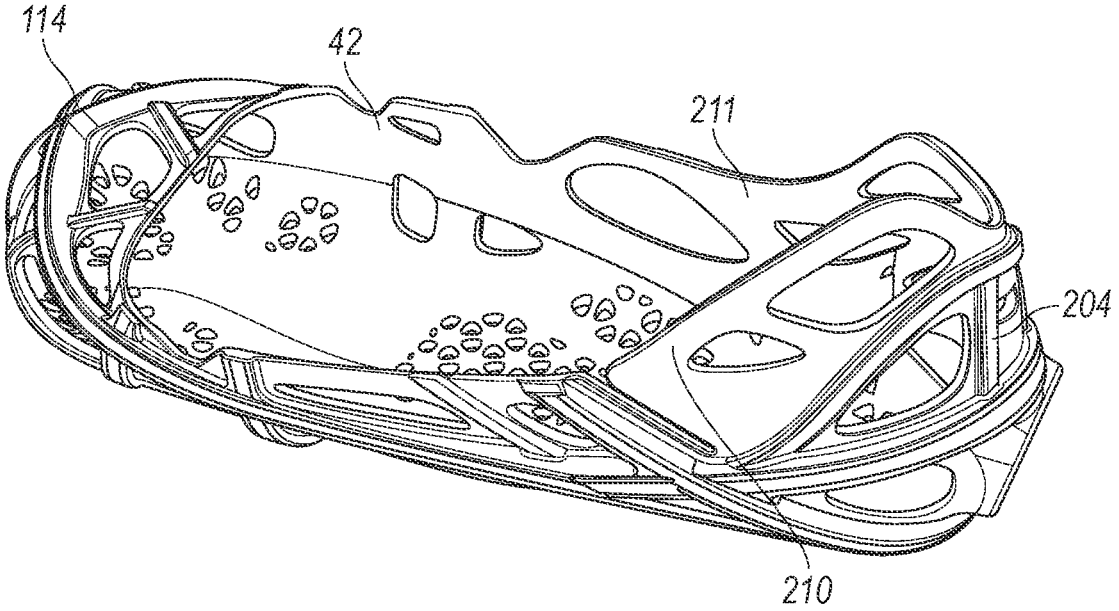
FIG. 14 is a top isometric view of the plantar shell of the shoe assembly of FIG. 12.
Figure 15:
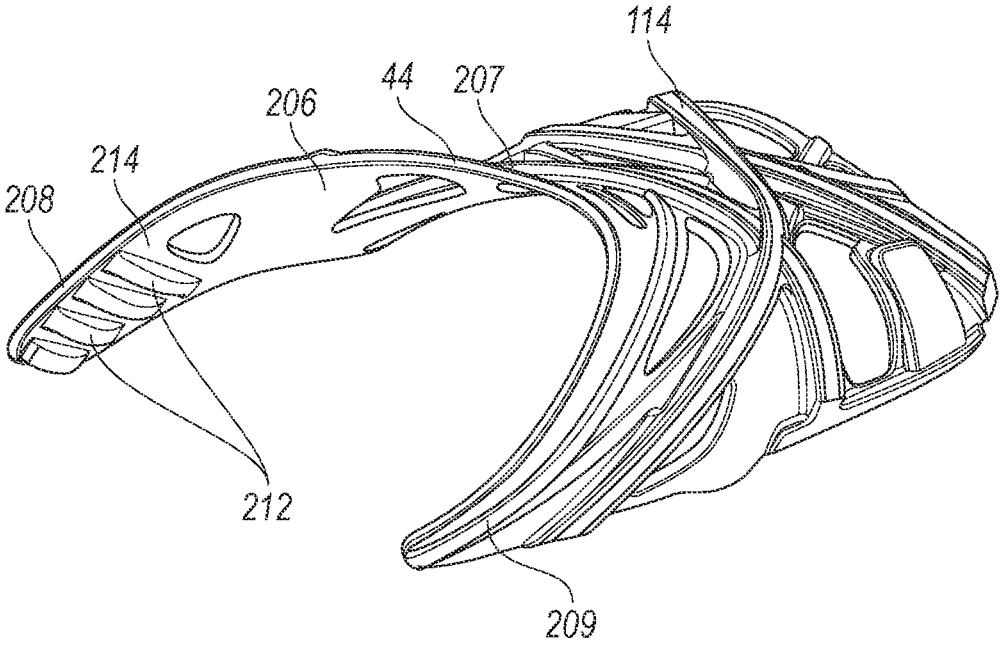
FIG. 15 is a top, rear isometric view of the dorsal shell of FIG. 12 shown removed from the plantar shell.

FIGS. 12 and 13 are side and top isometric views of the plantar and dorsal shells 42 and 44 of the shoe assembly 200 of FIG. 11A with the strap removed. FIG. 14 is a top isometric view of the plantar shell 42, and FIG. 15 is a top, rear isometric view of the dorsal shell 44 shown removed from the plantar shell 42 of the shoe assembly. In the illustrated embodiment, the rear lateral portion 206 of the dorsal shell 44 has a rigid lateral engagement flange or panel 208 extending downwardly and/or rearwardly, such as from a side or side portion of the dorsal shell 44, generally adjacent to the lateral malleolus portion of a wearer's foot and overlapping a lateral wall portion 210 of the plantar shell 42 adjacent to the heel portion 204. The rigid engagement panel 208 is positioned to be under the strap 202 (FIG. 11A), such that when the strap 202 is tightened, the panel 208 is held rigidly against the lateral wall portion 210 of the plantar shell 42.

In the illustrated embodiment, the engagement panel 208 is a lateral engagement panel ("lateral engagement panel 208") configured to be aligned with and/or engage at least a portion of a lateral side of a wearer's foot, e.g., generally adjacent to the lateral malleolus portion of the wearer's foot. Additionally, or alternatively, the dorsal shell 44 can further include a medial engagement panel 209 extending downwardly and/or rearwardly, generally adjacent to a medial malleolus portion of the wearer's foot (e.g., opposite the lateral malleolus portion) and overlapping a medial wall portion 211 (FIG. 14) of the planter shell 42 (e.g., opposite the lateral wall portion 210). The medial engagement panel 208 can be at least generally similar or identical in structure and/or function to the lateral engagement panel 208, but with respect to different (e.g., opposite) portion(s) and/or side(s) of the wearer's foot. Accordingly, a person of ordinary skill in the art will understand that the medial engagement panel 209 can include at least some or all of the features described with reference to the lateral engagement panel 208, but configured to be aligned with one or more different (e.g., opposite) portions and/or sides of the wearer's foot. In these and other embodiments, the dorsal shell 44 can further include an intermediate or instep engagement portion 207 configured to be aligned with and/or engage at least a portion of the instep portion 22 (FIG. 1) of the wearer's foot and/or a malleolus region of the wearer's foot. The instep engagement portion 207 can be positioned between the lateral and medial engagement panels 208, 209. At least part of the instep engagement portion 207 is positioned to be under the strap 202 (FIG. 11A), such that when the strap 202 is tightened, the instep engagement portion 207 is held rigidly against (e.g., compresses) the instep portion 22 of the wearer's foot and/or drive the wearer's heel portion 18 toward and/or into the heel portion 204 of the shoe assembly 200.

As seen in FIG. 15, one or more stiffeners 212 are provided on the rigid panel 208 along the portion that engages the plantar shell's lateral wall portion. The stiffeners 212 can be configured to provide the desired amount of stiffness in accordance with the selected performance and comfort for the personalized shoe assembly 200 (FIG. 11A). In the illustrated embodiment, the stiffeners 212 project inwardly from the interior wall 214 of the engagement panel 208 and configured to be held firmly against the lateral wall portion 210 of the plantar shell 42 (FIG. 12). In other embodiments, stiffeners 212 can be provided on the exterior wall 216 (FIG. 13) of the panel 208.

In the illustrated embodiment, the engagement panel 208 is an integral component of the dorsal shell 44 along the lateral posterior portion of the shell. In other embodiments, the dorsal shell's engagement panel 208 can be a separate component affixed to the dorsal shell 44 and positioned to extend over and overlap with the plantar shell's lateral wall portion 210. In some embodiments, the engagement panel 208 may be removable and replaceable with panels of different sizes and/or stiffness to achieve desired performance characteristics. The engagement panel 208 is shown in the figures on the lateral side of the footwear assembly 200. In other embodiments, a similar flap can be provided on the medial side of the dorsal shell 44 for engagement with a medial sidewall of the plantar shell 42 generally in the same area.

The engagement panel 208 is shaped and sized so the overlapping arrangement with the plantar shell's lateral wall portion 210 provides a very stable and rigid structure adjacent to the lateral malleolus portion of the wearer's foot. Additionally, or alternatively, the medial engagement panel 209 is shaped and sized so the overlapping arrangement with the plantar shell's medial wall portion 211 provides a very stable and rigid structure adjacent to the medial malleolus portion of the wearer's foot. In these and other embodiments, the instep engagement portion 207 is shaped and sized to provide a very stable and rigid structure adjacent to the instep portion 22 of the wearer's foot. The lateral engagement panel 208, the medial engagement panel 209, and/or the instep engagement portion 207 provide a blocking structure that helps block or minimize the movement of the wearer's foot, ankle, and lower leg away from the neutral position, particularly during the downstroke of the pedal cycle.

The arrangement of the lateral and medial engagement panels 208, 209, the lateral and medial wall portions 210, 211, the instep engagement portion 208, and the strap also directs the loads from the wearer's foot, ankle, and lower leg into the caging system 45 of the footwear assembly 200 to efficiently transfer the loads and associated power to the pedal for increased performance during each pedal cycle. For example, during the pedal cycle, the wearer's foot can undergo dorsiflexive motion, pronation, and/or supination. In conventional cycling shoes, this motion of the wearer's foot moves the wearer's foot relative to the conventional cycling shoe (e.g., the wearer's foot slides or moves within the conventional cycling shoe) and/or cause the wearer's foot to deform the conventional cycling shoe. In contrast to conventional cycling shoes, the cycling shoe assembly 200 of the present technology can capture (e.g., inhibit or prevent) at least part of all of the dorsiflexive, pronation, and/or supination motion of the wearer's foot and direct loads and associated power associated with this motion to the pedal. More specifically, the instep engagement portion 207 can be positioned to capture (e.g., inhibit or prevent) dorsiflexive motion of the wearer's foot, and one or both of the lateral engagement panel 208 and the medial engagement panel 209 can be positioned to capture (e.g., inhibit or prevent) pronation and/or supination motion of the wearer's foot, e.g., without or substantially without allowing the wearer's foot to (i) move relative to the cycling shoe assembly 200 and/or (ii) deform the cycling shoe assembly 200. This is described further with reference to FIGS. 17A-18B.

Figure 16C:
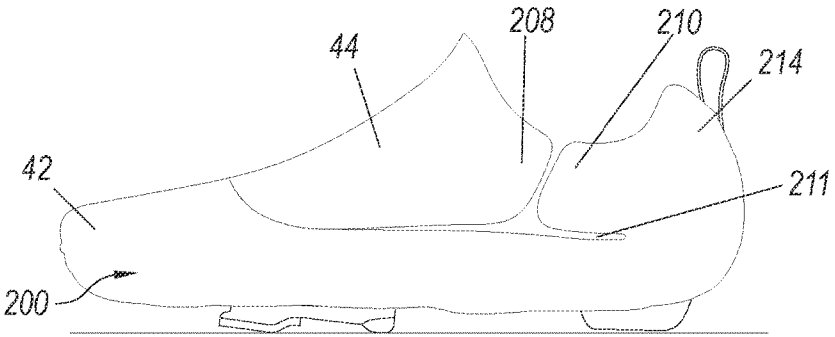
FIGS. 16A-16E are side elevation views of alternate embodiments of the shoe assemblies with lateral engagement panels in accordance with the present technology.
Figure 16D:
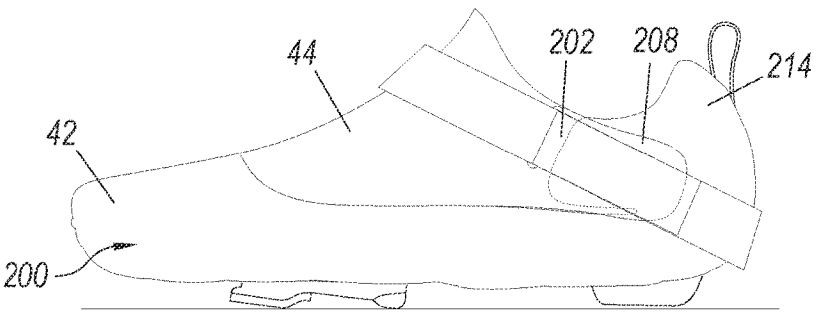
Figure 16E:
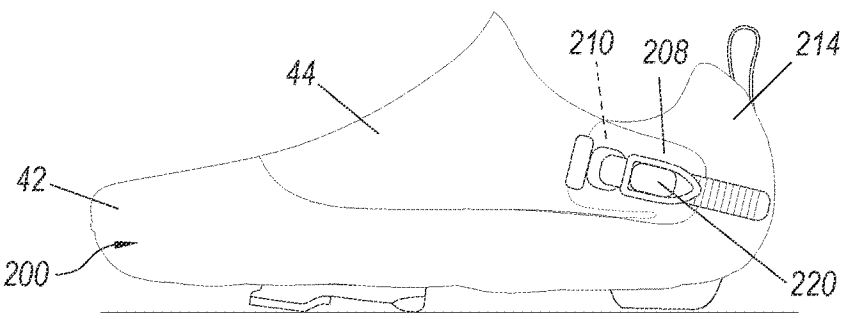
Figure 16A:
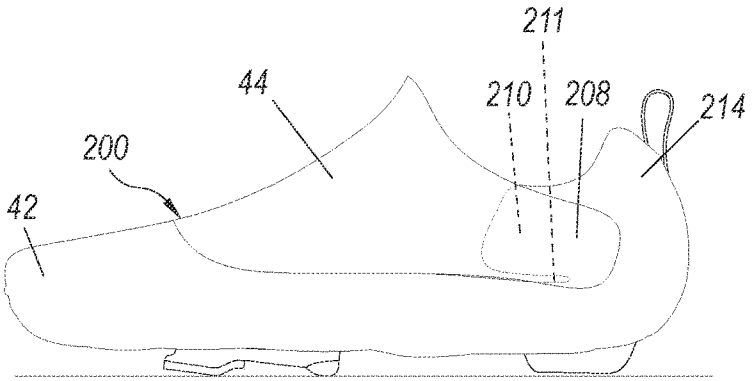
Figure 16B:
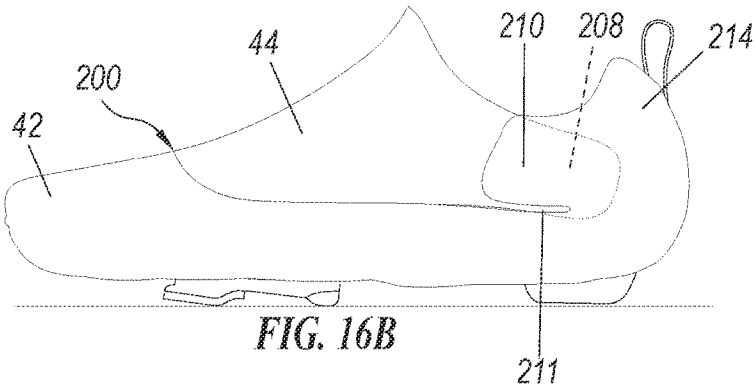
Figure 17A:
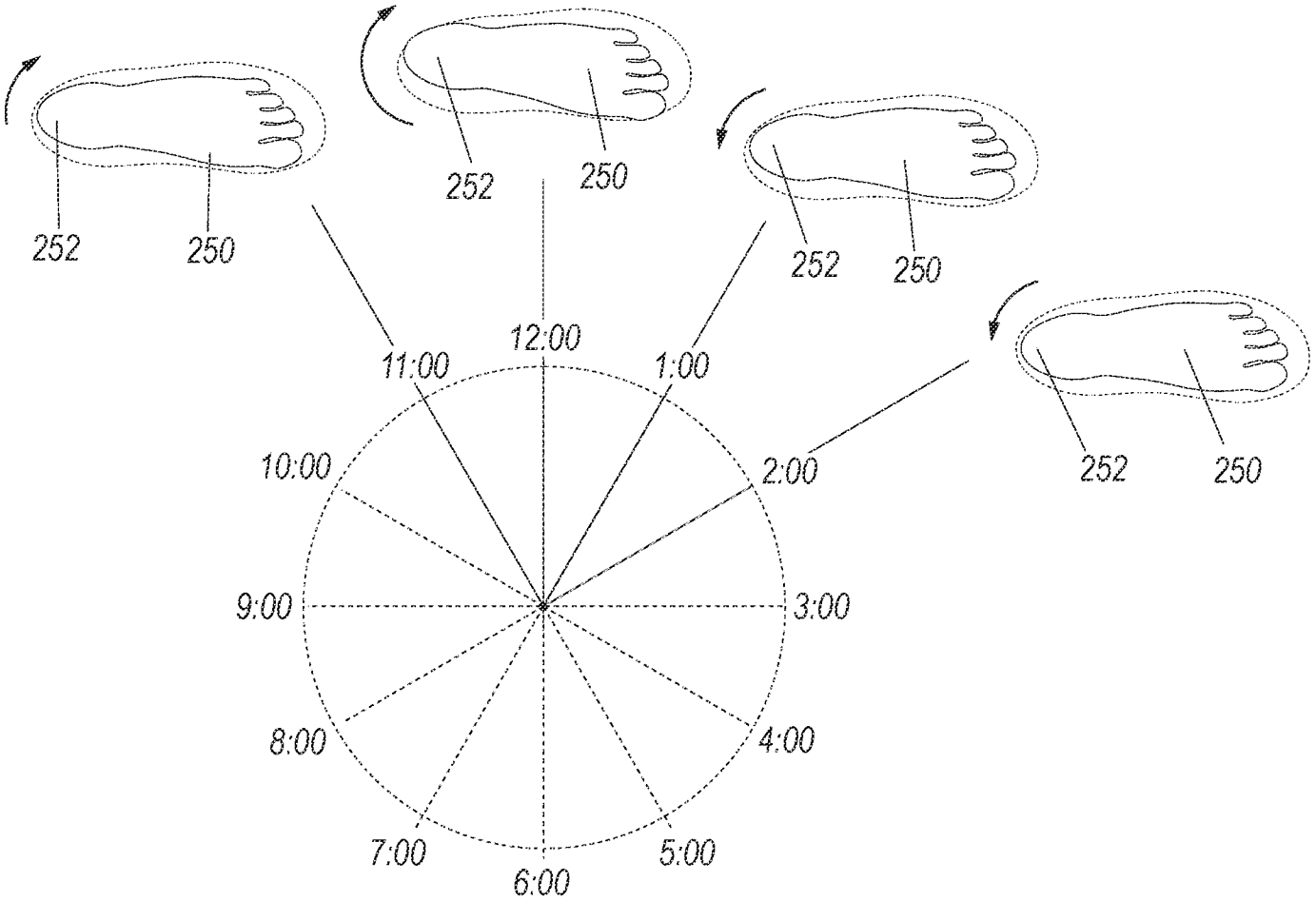
FIG. 17A is a schematic illustration of rotation of a wearer's leg and foot at illustrated portions of a pedal cycle.
Figure 17B:
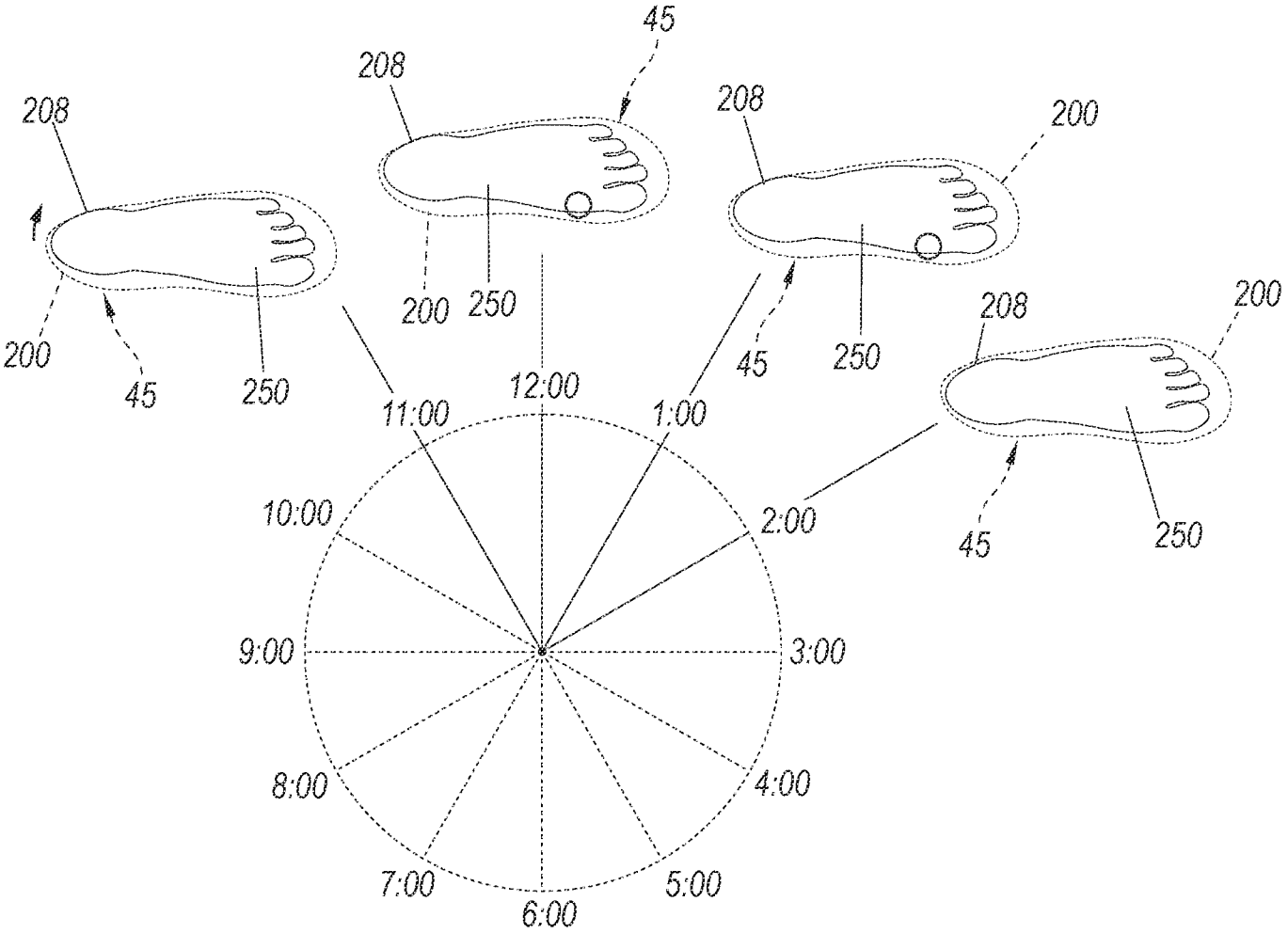
FIG. 17B is a schematic illustration of the foot position with rotation blocked by the shoe assembly at illustrated portions of a pedal cycle in accordance with aspects of the present technology.

FIGS. 16A-16E are side elevation views of alternate embodiments of the shoe assembly 200 with different configurations of the dorsal shell's engagement panel 208 and the plantar shell's lateral wall portion 210. FIG. 16A illustrates an embodiment in which the dorsal shell's lateral engagement panel 208 overlaps the exterior side of the plantar shell's lateral wall portion 210. The plantar shell's lateral wall portion 210 is shown in a cantilevered arrangement with a flex slot 211 below the lateral wall portion 210, which can be used to control the stiffness or flexibility of the lateral wall portion 210 to resist the loads and to maintain the neutral alignment of the wearer's foot during the pedal cycle. In these and other embodiments, the stiffness or flexibility of the lateral wall portion 210 can be based at least partially on a thickness of the plantar shell 42 and/or a number and/or position of one or more of the reinforcement ribs 114 (FIGS. 17A and 17B). FIG. 16B shows the shoe assembly 200 with the dorsal shell's lateral engagement panel 208 overlapping the plantar shell's lateral wall portion 210 on the interior side of the lateral wall portion. FIG. 16C shows the dorsal shell's lateral engagement panel 208 adjacent to, but not overlapping with, the plantar shell's lateral wall portion 210. In this configuration, the strap 202 can span across the adjacent engagement panel 208 and lateral wall portion 210 to control the stiffness of the shoe to maintain the neutral alignment of the wearer's foot. FIG. 16D shows the strap 202 spanning across the overlapping arrangement of the dorsal shell's lateral engagement panel 208 and the plantar shell's lateral wall portion 210. FIG. 16E shows an embodiment with a buckle or ratchet system 220 securing the dorsal shell's engagement panel 208 in position relative to the plantar shell's lateral wall portion 210. Other embodiments can have other arrangements of the lateral engagement panel 208 and the lateral wall portion 210. In yet other embodiments, the shoe assembly 200 can utilized the plantar shell's lateral wall portion 201 to maintain the neutral alignment of the wearer's foot and to transfer loads through the caging system 45 to the pedal without including a lateral engagement panel 208 on the dorsal shell.

FIG. 17A is a schematic illustration of a rotational position or tendency of a wearer's foot 250 at illustrated portions of a pedal cycle 260 when the wearer's foot 250 is not supported or constrained to remain in the neutral position. The pedal cycle 260 is a full 360-degree rotation of the pedal, which can be described with a clock-face analogy, wherein the top-most position of the pedal cycle 260 corresponds to a 12:00 position (i.e., twelve o'clock), the bottom-most position corresponds to a 6:00 position (i.e., six o'clock), halfway through the down-stroke of the pedal cycle 260 corresponds to a 3:00 position (i.e., three o'clock), and halfway through the up-stroke of the pedal cycle 260 corresponds to a 9:00 position (i.e., nine o'clock). Using this clock-face analogy, when the wearer's foot 250 is on the upstroke approximately at the 11:00 position, the wearer's heel 252 of the foot 250 has a tendency to rotate outwardly, which can be the beginning of a pronation movement when the foot 250 is not constrained. As the wearer's foot 250 approaches the 12:00 position, the outward rotational movement of the foot 250 would be approximately at the maximum if the foot 250 is not adequately constrained from the rotational movement. As the wearer's foot 250 moves to approximately the 1:00 position, the wearer's heel 252 begins rotating back in toward a neutral alignment, which is reached by the time the foot 250 is approximately at the 2:00 position.

FIG. 17B illustrates the shoe assembly 200 of the current technology at approximately the same 11:00, 12:00, 1:00, and 2:00 positions. The shoe assembly 200 with the configuration of the personalized plantar shell 42 and the dorsal shell 44 has the lateral engagement panel 208 and/or the lateral wall portion 210 that blocks the wearer's foot 250 from rotating away from the neutral position. This results in loading the wearer's forefoot portion, such as at the first metatarsal, through which power can be transmitted through the rigid caging system 45 to the pedal. Accordingly, the wearer's foot 250 substantially remains in the neutral position as the foot 250 transitions from the upstroke to the downstroke and to the power portion of the pedal cycle. A conventional cycling shoe with the soft upper and the general, non-personalized fit cannot provide the optimal fit and energy capture provided by the shoe assembly 200 of the present technology. The illustrated shoe assembly 200 also directs the torsional and lateral loads directly into the footwear's caging system 45 for pressure equalization and efficient transfer to the pedal earlier in the pedal cycle to more efficiently capture the loads for conversion to additional power during the pedal cycle. The sooner the vertical loads generated by the wearer can be exerted on the pedal after the 12:00 position, the sooner the power portion of the pedal cycle can start. This means that a significantly greater amount of power can be generated during the down stroke of the pedal cycle 260 (i.e., 12:00 position to 6:00 position). Accordingly, the rigid caging system 45 with the dorsal shell's rigid engagement panel 208 interfacing with the plantar shell's lateral wall portion 210 helps maintain that neutral position for efficient power transfer to the pedal, particularly between the downstroke of the pedal cycle.

The wearer's foot 250 can also undergo supination movement (e.g., inward heel rotation), in addition to or in lieu of the pronation movement (e.g., outward heel rotation) described previously. In such embodiments, the configuration of the personalized plantar shell 42 and the dorsal shell 44 has the medial engagement panel 209 and/or the medial wall portion 211 that blocks the wearer's foot 250 from rotating away from the neutral position. This results in loading the wearer's forefoot portion, such as at the first metatarsal, through which power can be transmitted through the rigid caging system 45 to the pedal. Accordingly, the wearer's foot 250 substantially remains in the neutral position as the foot 250 transitions from the upstroke to the downstroke and to the power portion of the pedal cycle.

In some embodiments, the caging system 45 can increase (e.g., maximize) force and/or power transfer to the pedal during the upstroke portion (i.e., 6:00 position to 12:00 position) of the pedal cycle. For example, the caging system 45 can be configured to hold the heel portion 18 of the wearer's foot 250 in contact with the heel portion 204 of the shoe assembly 200 (e.g., via the strap 202), as described previously with reference to FIGS. 11A and 11B. During the upstroke portion, the upward and/or rearward motion of the wearer's foot naturally directs the wearer's heel portion 18 toward the heel portion 204 of the shoe assembly 200. In conventional cycling shoes, this causes the wearer's foot to slide relative to the cycling shoe. In contrast to conventional cycling shoes, because the caging system 45 with the strap 202 (or without the strap) can hold the heel portion 18 of the wearer's foot 250 in constant, firm contact with the heel portion 204 of the shoe assembly 200, the wearer's foot 250 remains in contact with the heel portion 204 of the shoe assembly 200 at the beginning of the upstroke portion (i.e., at the 6 o'clock position). This results in the wearer of the shoe assembly 200 being able to generate power at the beginning of the upstroke portion (i.e., at the 6 o'clock position) and/or without the loss of power/efficiency associated with the foot movement experienced in conventional cycling shoes during the upstroke portion.

Figure 18B:
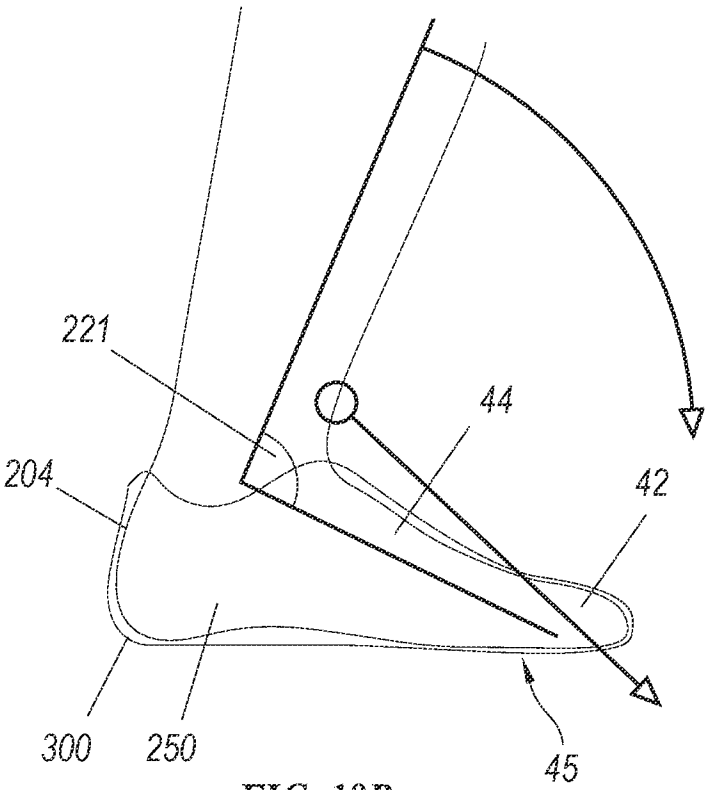
FIGS. 18A and 18B are schematic views of the dorsiflexion angles of a wearer's lower leg and ankle at portions of a pedal cycle.
Figure 18A:
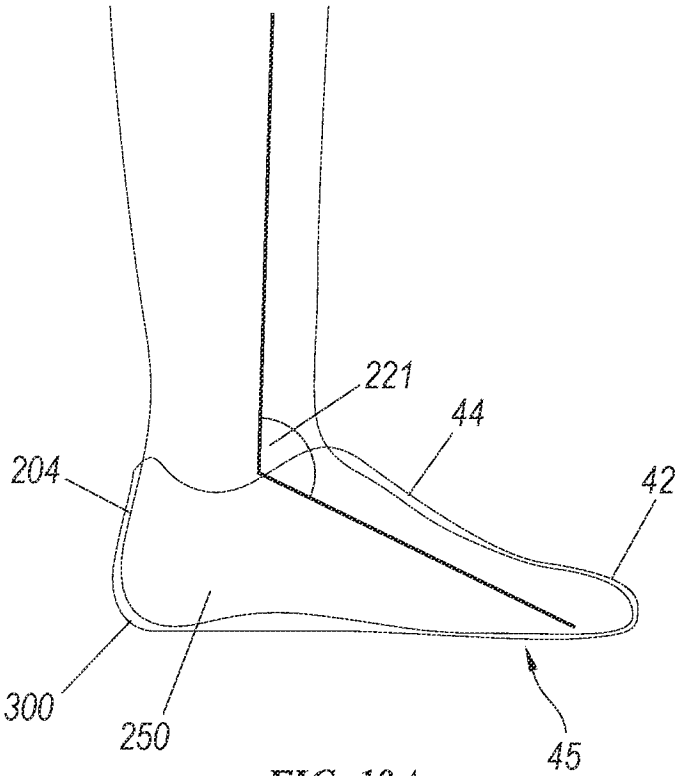

FIGS. 18A and 18B are schematic views of the dorsiflexion angles of a cyclist's lower leg and ankle at portions of the pedal cycle of FIG. 17B. A wearer's ankle moves and flexes during a pedal cycle. For example, a relatively minimum dorsiflex movement (FIG. 18A) occurs during approximately the 9:00-10:00 portion of the pedal cycle (i.e., on the up-stroke). The maximum dorsiflex movement (FIG. 18B) typically occurs as the wearer's foot approaches and moves through the top of the pedal stroke at 12:00 and during approximately the 12:00-3:00 portion of the pedal cycle, which is within the power-generating portion of the pedal cycle. During this maximum dorsiflexion portion, the angle of the wearer's lower leg relative to the foot is decreased (i.e., there is more flex, so the angle is more acute), and the anterior portion of the lower leg near the lateral malleolus 221 moves forwardly toward the wearer's foot.

Figure 19:
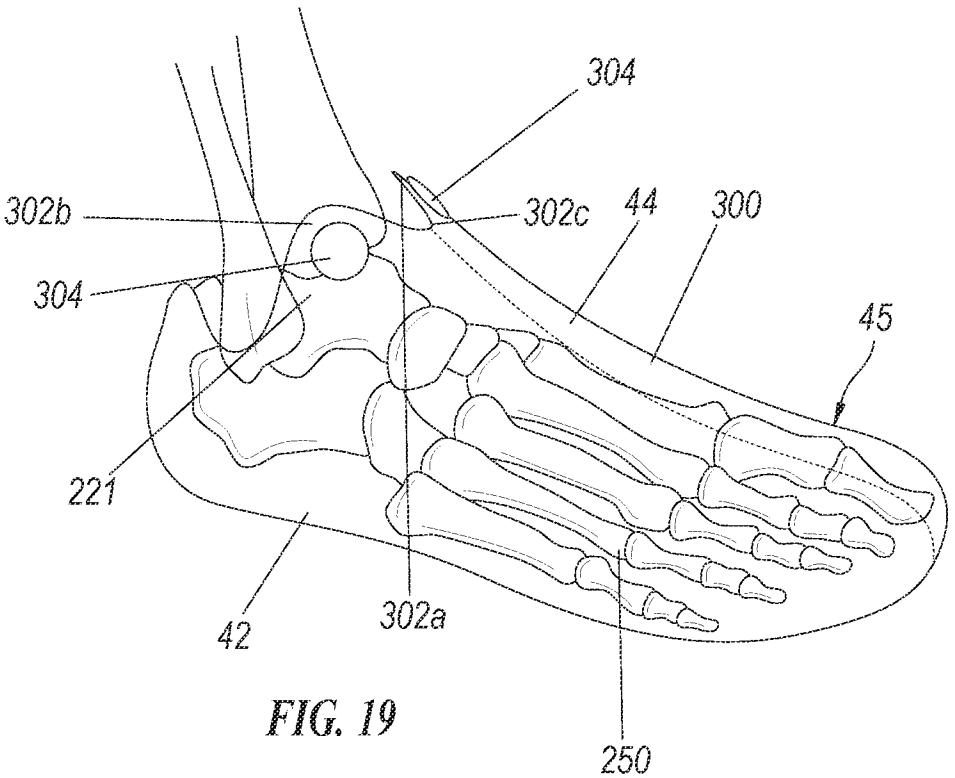
FIG. 19 is a schematic view of the bones of a wearer's lower leg, ankle, and foot in a shoe assembly in accordance with an embodiment of the present technology.
Figure 20:
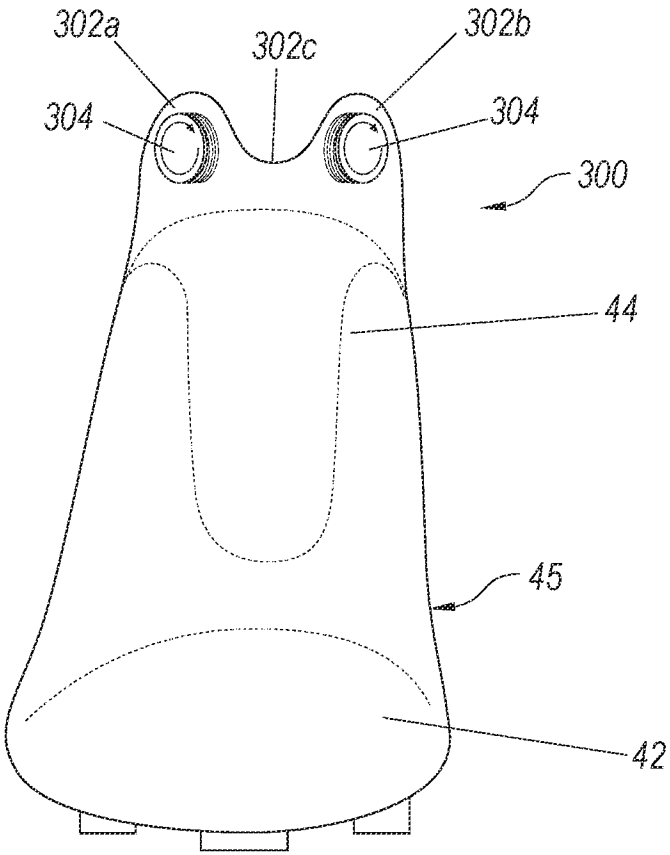
FIG. 20 is a front elevation view of the shoe assembly of FIG. 19.

As seen in FIGS. 19 and 20, the shoe assembly 300 of the illustrated embodiment has one or more extended instep engagement and/or dorsiflexion portions 302 along the upper posterior portion of the dorsal shell 44, individual ones of which can be at least generally similar or identical in structure and/or function to the instep engagement portion 207 of the shoe assembly 200. The dorsiflexion portions 302 are configured to extend upwardly for engagement with the wearer's lower leg along the portion adjacent to the lateral malleolus, the medial malleolus, and/or the shin, depending on the length of the dorsiflexion portion 302. In the illustrated embodiment, the dorsal shell 44 has dorsiflexion portions 302 on medial and lateral sides of the centerline of the lower leg. Each of the medial and lateral dorsiflexion portions 302*a* and 302*b* extend upwardly so the wearer's leg will press against the dorsiflexion portion as the amount of flex increases (i.e., the flex angle decreases), particularly as the wearer's foot approaches and moves through the top of the pedal stroke at 12:00 and during the beginning of the power stroke portion of the pedal cycle. The dorsiflexion portions 302*a* and 302*b* can be configured to provide a center relief 302*c* between them into which the wearer's lower leg can flex. The center relief 302*c* is can be configured to avoid pressure on tendons or other potentially sensitive areas of the ankle and lower leg. The engagement with one or both of the dorsiflexion portions 302*a* and 302*b* helps maintain the neutral alignment of the wearer's lower leg, ankle, and foot during the pedal cycle. The engagement with one or both of the dorsiflexion portions 302*a* and 302*b* also increases (e.g., maximizes) the load transfer into the rigid caging system 45 to the pedal during the pedal cycle. A height of one or more of the dorsiflexion portions 302 can correspond to a magnitude of the load transferred into the rigid caging system 45. For example, dorsiflexion portions 302 that extend further up the wearer's leg are expected to provide increased load transfer/efficiency compared to dorsiflexion portions 302 that extend lesser distances up the wearer's leg. This is described in further detail below with reference to FIGS. 26A-28B.

In the embodiments illustrated in FIGS. 19 and 20, the dorsiflexion portions 302 are integrated into the dorsal shell 44 to form a single-piece assembly therewith. In other embodiments, one or more of the dorsiflexion portions 302 can be detachably coupled to the dorsal shell 44. In such embodiments, individual ones of the dorsiflexion portions 302 can be interchanged with one or more other dorsiflexion portions 302 having different heights, thicknesses, stiffnesses, and/or the like. Additionally, or alternatively, one or more of the dorsiflexion portions 302 can be moved, rotated, and/or otherwise repositioned relative to the dorsal shell and/or the wearer's foot and/or ankle to improve the fit, comfort, and/or power transfer between the wearer and the shoe assembly 300.

Figure 21A:
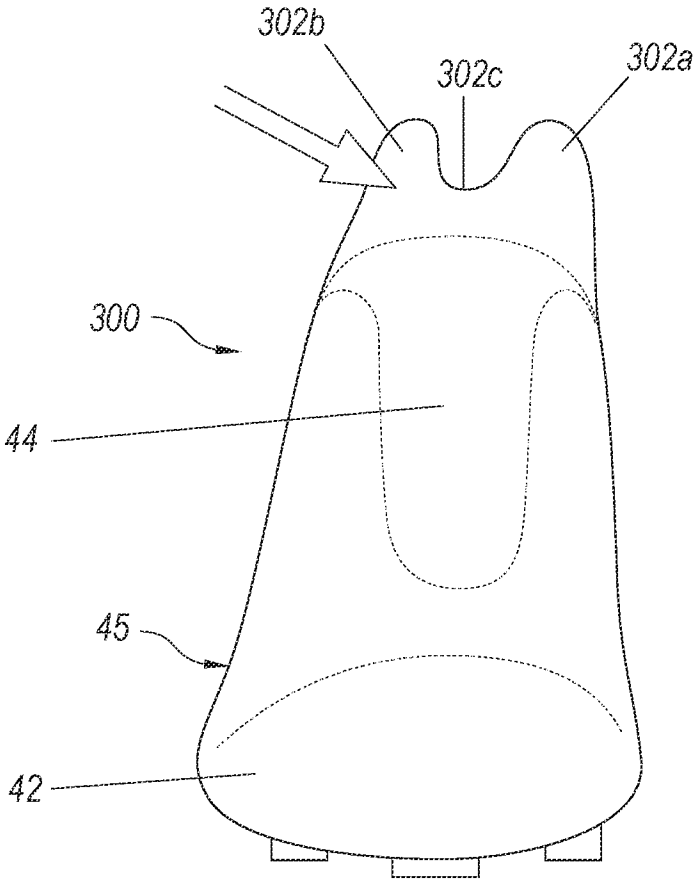
FIGS. 21A and 21B are front elevation views of other embodiments of the shoe of FIG. 18.
Figure 21B:
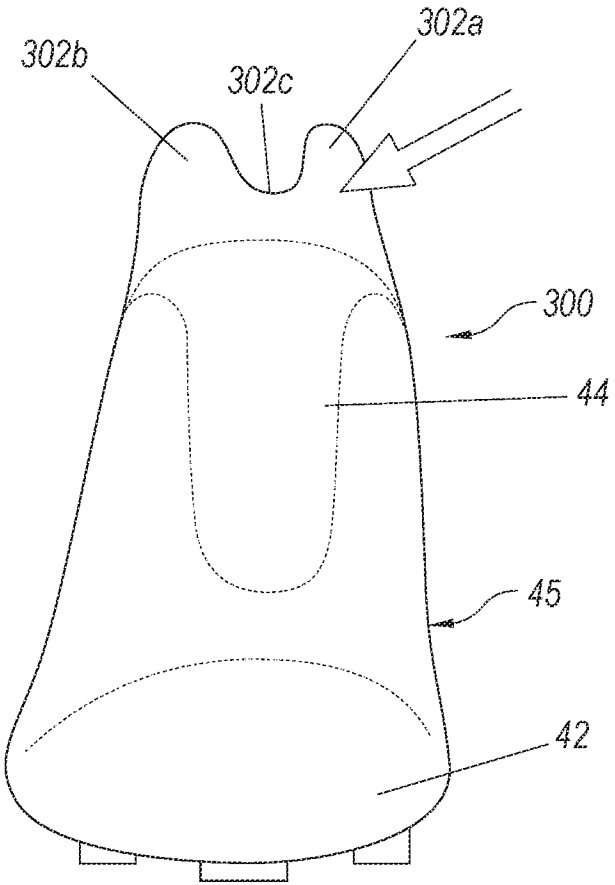

As seen in FIGS. 21 and 22, which are front views of the shoe assembly 300 configured for a wearer's right foot, the shoe assembly 300 can have an asymmetric arrangement of the dorsal shell 44 between the medial and lateral dorsiflexion portions 302*a* and 302*b*. For example, in FIG. 21, the medial dorsiflexion portion 302*a* has a wider configuration than the lateral dorsiflexion portion 302*b*. This configuration may be beneficial to provide additional support toward the neutral position for a wearer who has greater rotation and linear motion in the lower leg and ankle in the medial direction during the pedal cycle. In another embodiment shown in FIG. 22, the lateral dorsiflexion portion 302*b* has a wider configuration than the medial dorsiflexion portion 302*a*. This configuration may be beneficial to provide additional support toward the neutral position for a wearer who has greater rotation and linear motion in the lower leg and ankle in the lateral direction, or has less rotation and linear motion in the lower leg and ankle in the medial direction. Accordingly, the dorsiflexion portions 302*a* and 302*b* may provide a configuration with select orthotic arrangements for the personalized fit of the wearer depending upon the anatomy and typical movement patterns of that wearer's lower leg, ankle and foot during a pedal cycle.

In some embodiments, as shown in FIGS. 19 and 20, the shoe assembly 300 can include one or more dorsiflex pads 304 affixed or otherwise coupled to the dorsiflex portions 302. The dorsiflex flex pad 304 has an engagement surface against which the wearer's leg engages and presses, such as during the flex motion. The adjustable dorsiflex pads 304 allow for a precise level of fit and load transfer control because the anatomy of the lower leg, ankle, and foot differ between wearers. The dorsiflex pad 304 can be adjustable and/or interchangeable to change the thickness of the dorsiflex pad 304. This allows the wearer to precisely control when and how the wearer's lower leg will engage the dorsiflex pads 304 during the pedal cycle, thereby controlling load transfer into the caging system 45. In some embodiments, the dorsiflex pad 304 may be adjustable to change the thickness of that pad, such as via a screw or other thread adjustment arrangement (FIG. 20), a shimmed arrangement, or other configuration with a variable thickness.

Figure 22A:
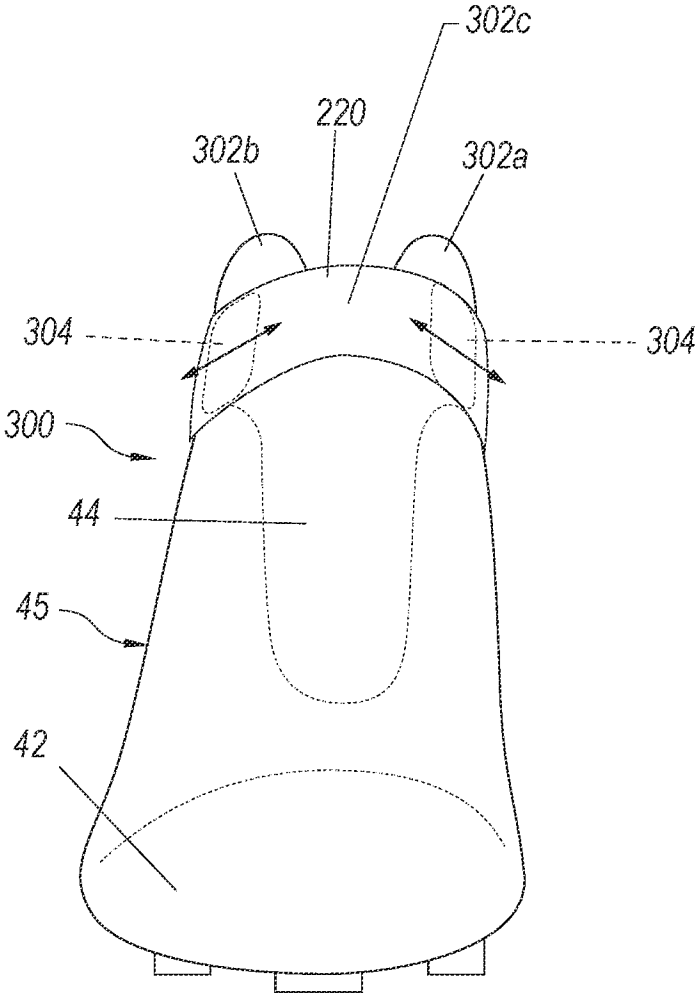
FIGS. 22A and 22B are front and side elevation views, respectively, of a footwear assembly of one or more embodiments with a strap and dorsiflexion pads.
Figure 22B:
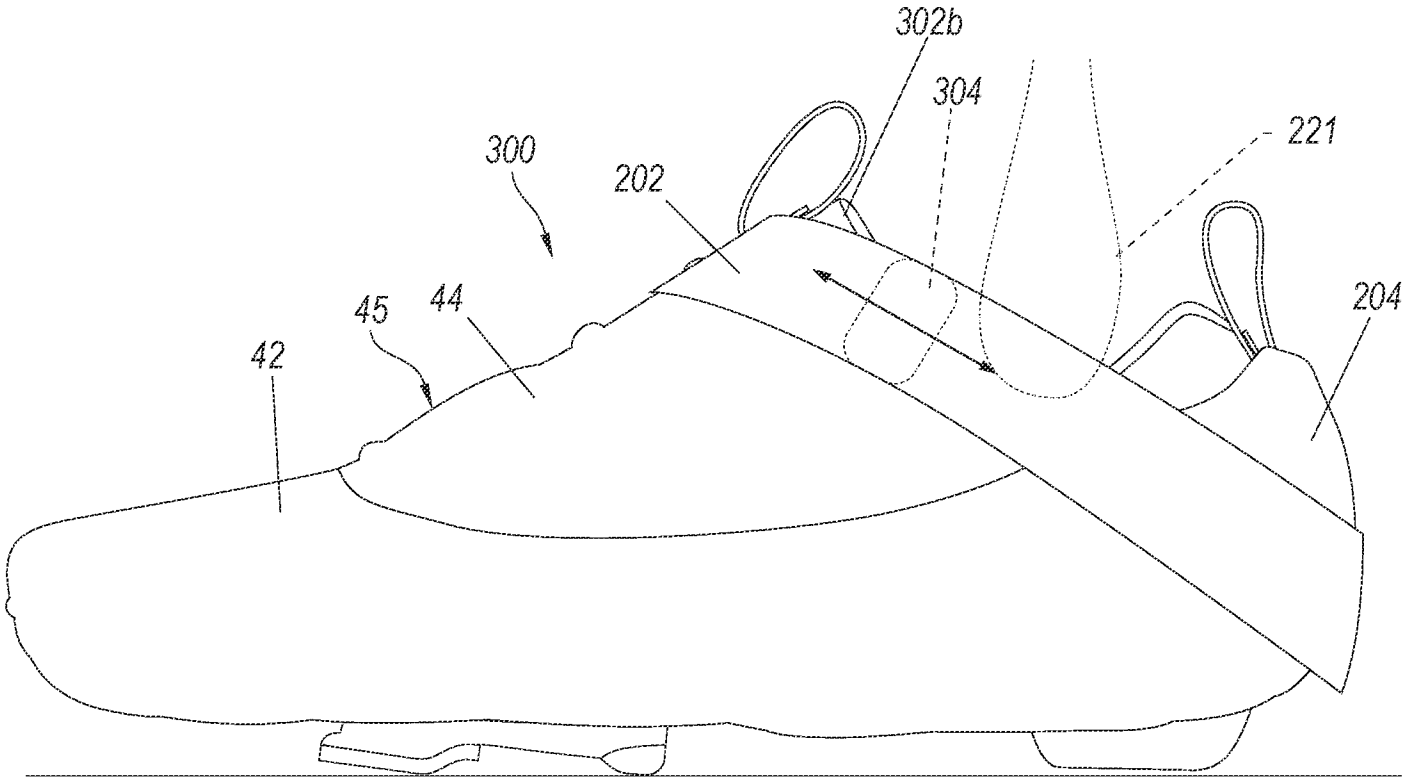
Figure 23A:
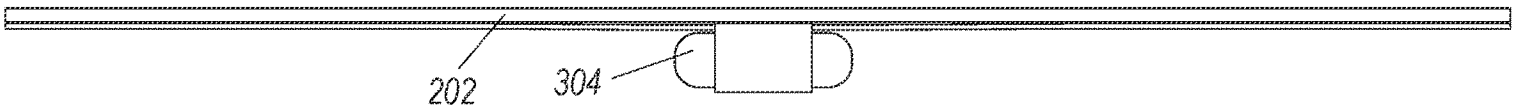
FIGS. 23A-23D are elevation views of the strap with a dorsiflexion pad in accordance with an embodiment of the present technology.
Figure 23B:
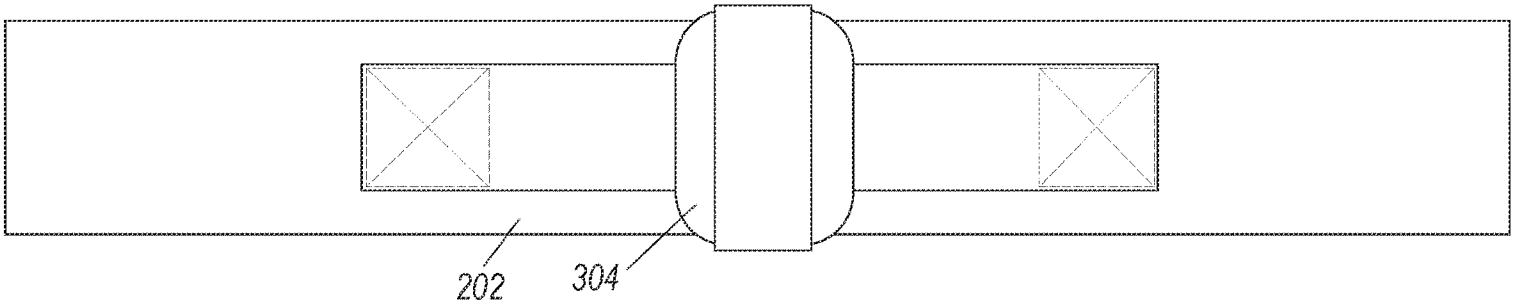
Figure 23C:
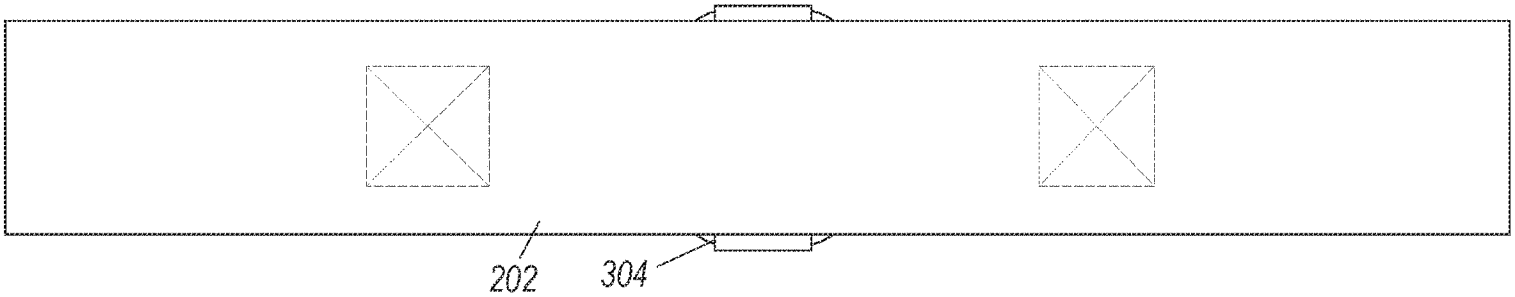
Figure 23D:
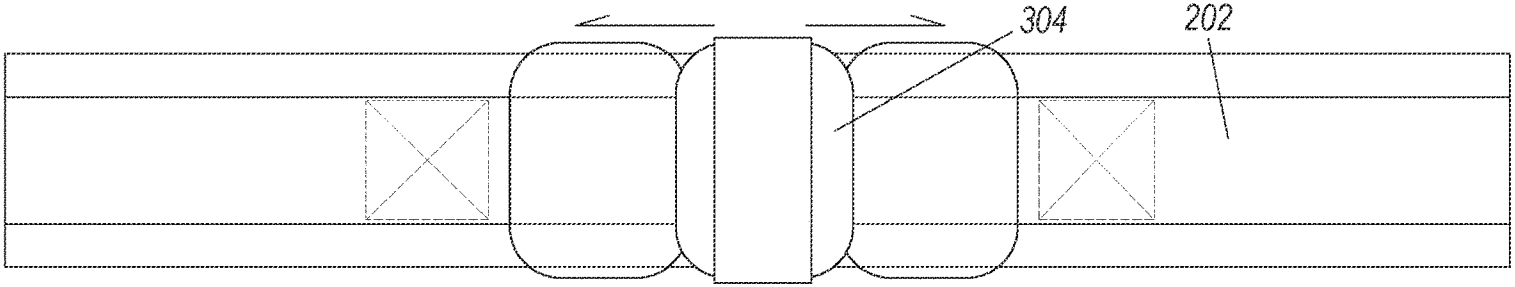

FIGS. 22A and 22B are front and side elevation views of a footwear assembly 300 with one or more dorsiflexion pads 304 positioned on the adjustable strap 202 and positioned to engage the dorsiflex portions 302 on the medial and/or lateral side of wearer's ankle or lower leg. The strap 200 is adjustable to control the effective position of the dorsiflex pads 304 relative to the dorsiflex portions 302 to transfer loads from the wearer's lower leg directly into the caging system 45 of the footwear assembly 300.

Figure 25:
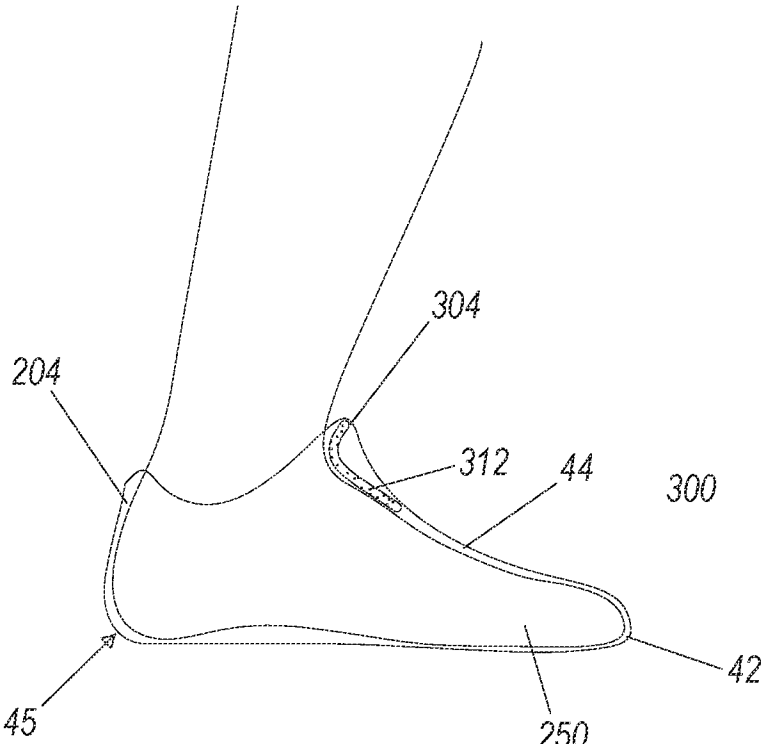
FIGS. 24 and 25 are schematic side views of other embodiments of shoe assemblies in accordance with embodiments of the present technology.
Figure 24:
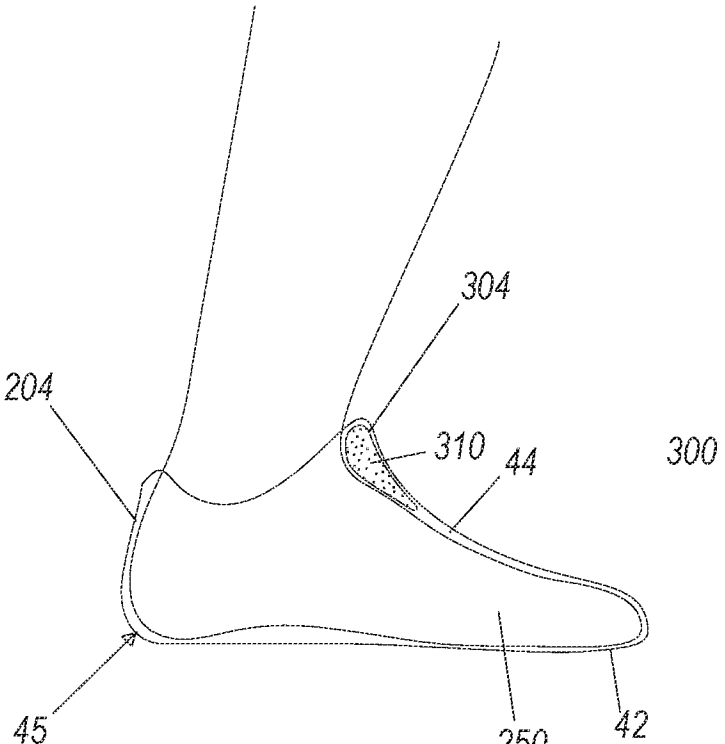

FIGS. 23A-23D illustrate a strap 202 of one or more embodiments with the dorsiflex pad 304 affixed to the interior portion of the strap 202. In one embodiment shown in FIG. 23D, the dorsiflex pad 304 is adjustable along a portion of the strap 202. In other embodiments, the position of the dorsiflex pad 304 can be fixed on the strap 202. In yet other embodiments, the dorsiflex pads 304 can have other configurations to provide a customized fit for the wearer. For example, the dorsiflex pad 304 shown in FIG. 24 can be a wedge member 310 attachable to the inner portion of the dorsal shell 44, one or more of the dorsiflex portions 302, and/or to the strap 202. The wedge member 310 can have a selected thickness sized to best fit the particular anatomy of the wearer. One wedge member 310 may be interchangeable with any one of a plurality of other wedge members 310 with different thicknesses. Accordingly, the wearer can be fitted with a wedge member with the appropriate thickness for that wearer's anatomy of the lower leg, ankle, and/or foot. Additionally, or alternatively, the position of the wedge member 310, and/or the arrangement of a plurality of wedge members 310, relative to the wearer's lower leg, ankle, and/or foot can be customized based at least partially on the wearer's anatomy. In another embodiment shown in FIG. 25, the dorsiflex pad 304 can be a shaped member, such as an L-shaped member, attachable to the inner portion of the dorsiflex portions 302. For example, the L-shaped member may be removably contained in a pocket located at the inner portion of the dorsiflex portion(s) 302 or on the strap 202.

Figure 26C:
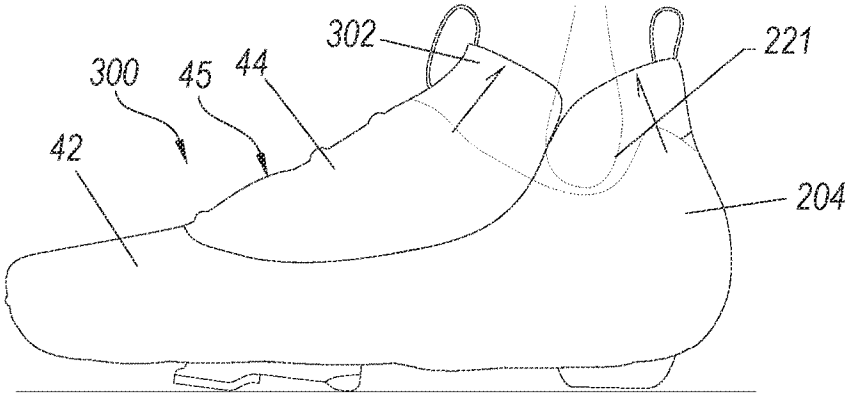
FIGS. 26A-26D are schematic side elevation views of shoe assemblies with increased heights in accordance with embodiments of the present technology.
Figure 26D:
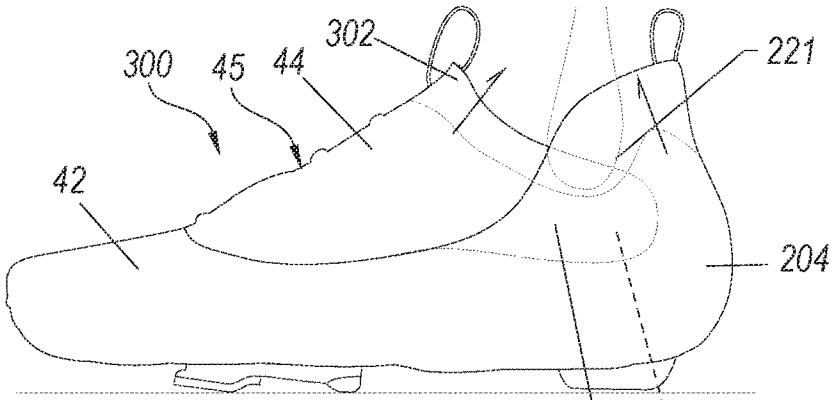

As discussed above, the dorsiflex portions 302 alone or with the dorsiflex pads 304 allows the wearer's ankle and/or lower leg to transmit loads to the caging system 45 via the dorsal shell 44 early in the pedal cycle when the ankle and leg begin to flex and as they move through the power portion of the pedal cycle. In some embodiments, the footwear assembly 300 has a low profile generally consistent with conventional cycling shoes with soft uppers. In other embodiments, the shoe assembly 300 can have higher profiles that extend higher up the wearer's ankle and/or lower leg. For example, FIGS. 26A-26D are schematic side elevation views of shoe assemblies of other embodiments with increased heights. For purposes of illustration and comparison, the height of a conventional cycling shoe is shown in dotted lines. FIG. 26A illustrates an embodiment of the shoe assembly 300 with a midrise dorsal shell configuration, which may include the dorsiflex portions 302 with or without the dorsiflex pads 304. In this configuration, the dorsal and plantar shells 44 and 42 can be configured with the engagement panel 208 and lateral wall portion 210 (with or without the strap 202) as discussed above.

Figure 26B:
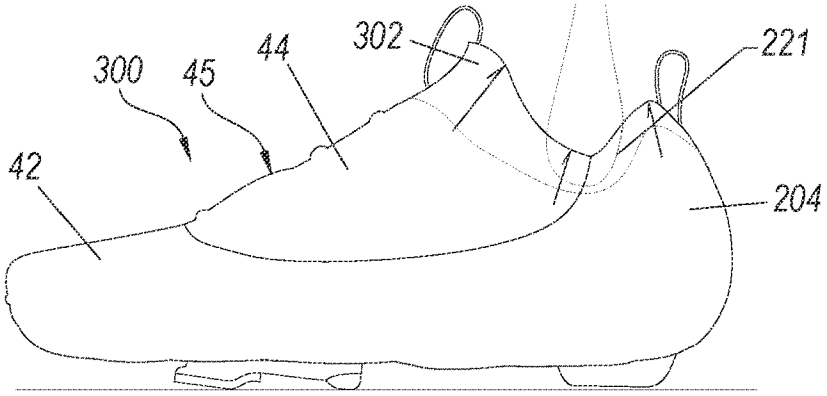
Figure 26A:
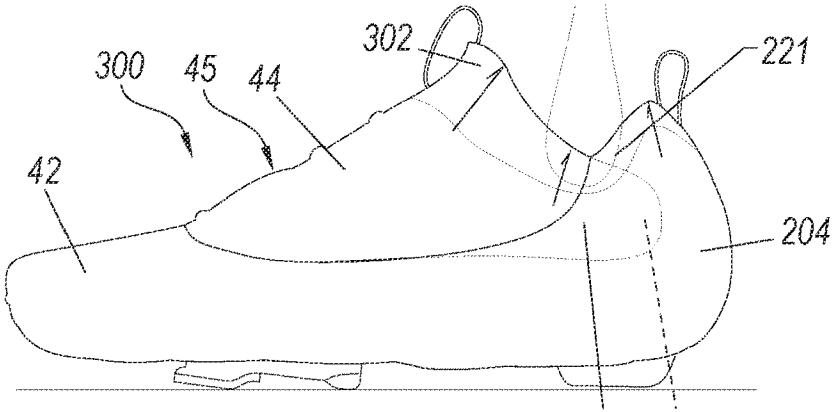

FIG. 26B illustrates the shoe assembly 300 with the midrise configuration and with the dorsal and plantar shells 44 and 42 that do not have the overlapping engagement panel 208 and lateral wall portion 210. FIG. 26C illustrates the shoe assembly 300 with the midrise configuration with a taller heel portion 320 that extends upwardly, up and around the wearer's ankle and lower leg adjacent to the lateral malleolus 221. This midrise configuration may or may not include the overlapping engagement panel 208 and lateral wall portion 210 and/or with or without the dorsiflex pads 304 on the dorsiflex portions 302. FIG. 26D illustrates an embodiment with a midrise heel portion 320 of the plantar shell 42, but with a dorsal shell 44 that has a lower rise as compared to the embodiment of FIG. 26C. The embodiments of FIGS. 26A-26D with the different heights can include liners and/or covers that match the shape and height of the dorsal shell 44 and/or the plantar shell 42. In other embodiments, the liners and/or covers may have a different shape that may allow portions of the dorsal shell 44 and/or the plantar shell 42 to extend beyond the perimeter of the respective liner or cover.

Figure 27A:
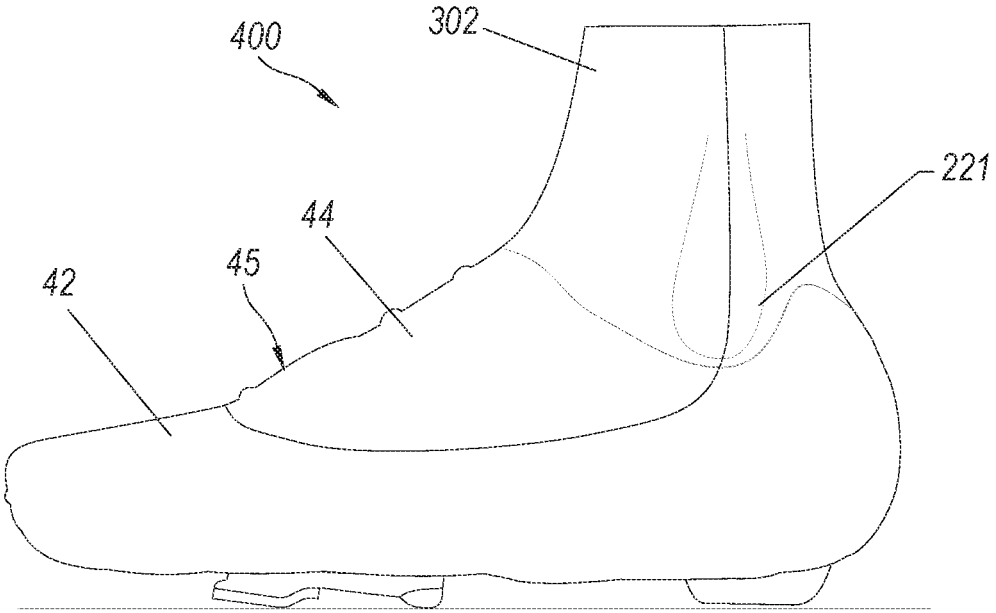
FIGS. 27A and 27B are schematic side elevation views of shoe assemblies with increased heights in accordance with embodiments of the present technology.
Figure 27B:
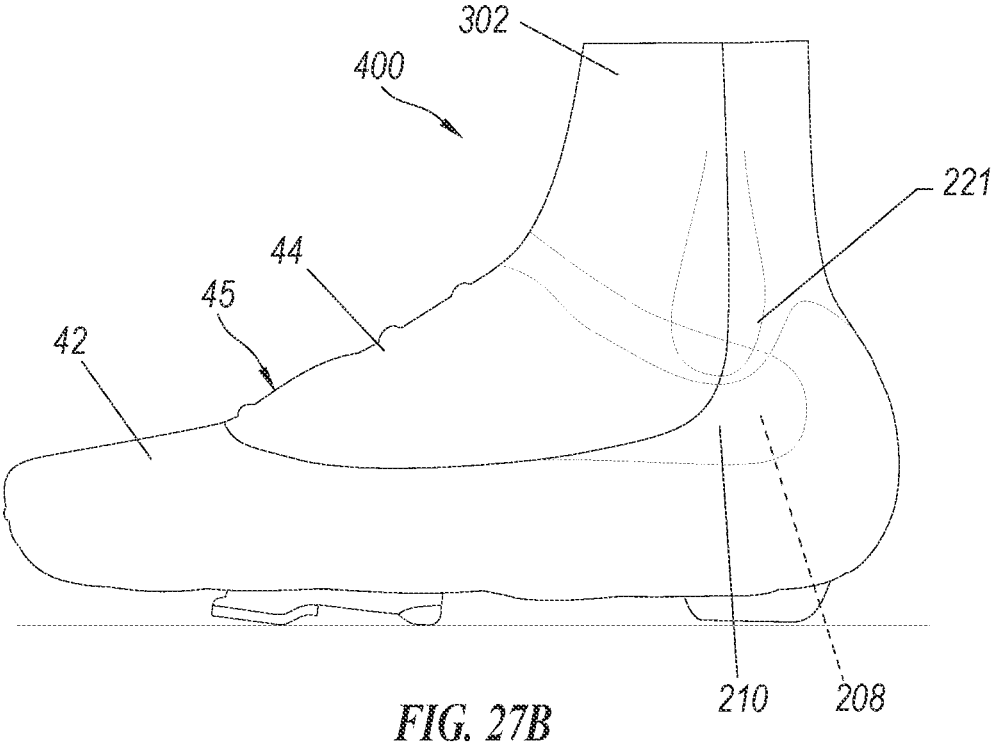

FIGS. 27A and 27B are schematic side elevation views of shoe assemblies 400 of other embodiments with a "high-top" configuration. For purposes of illustration and comparison, the height of a conventional cycling shoe is shown in dotted lines. In this illustrated embodiment, the plantar and dorsal shells 42 and 44 are constructed to extend around the wearer's ankle and the lower shin portion of the lower leg. The upper portion of the dorsal shell 44 defines an integral dorsiflex portion (with or without the dorsiflex pads) that are engaged upon flex of the wearer's lower leg and/or ankle, so as to provide a longer lever arm to transfer loads into the personalized caging system 45 for highly efficient power transfer to the pedal during the pedal cycle. The high-top shoe assembly 400 may or may not include a dorsal and plantar shell configuration having an overlapping or otherwise oriented engagement panel 208 and lateral wall portion 210 (FIG. 27B) as discussed above.

Figure 28A:
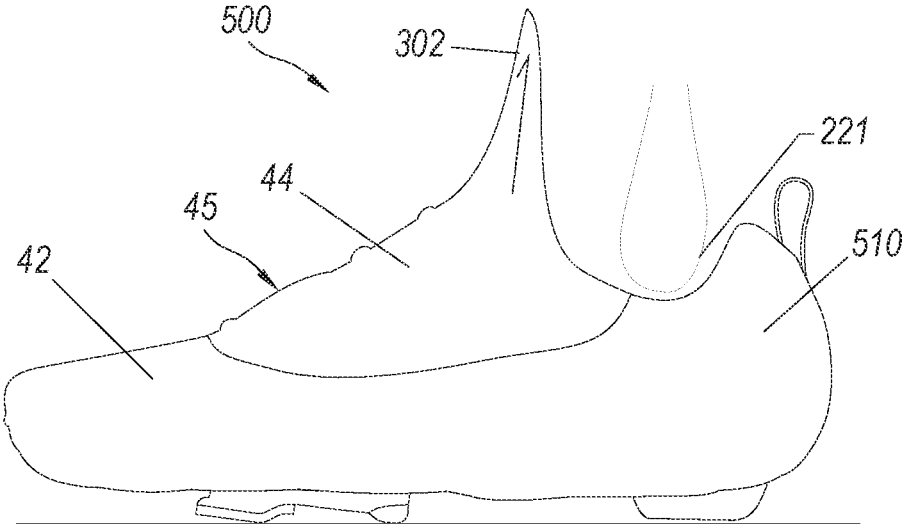
FIGS. 28A and 28B are schematic side elevation views of shoe assemblies with a dorsal shell having an increased height over the ankle and shin area in accordance with embodiments of the present technology.
Figure 28B:
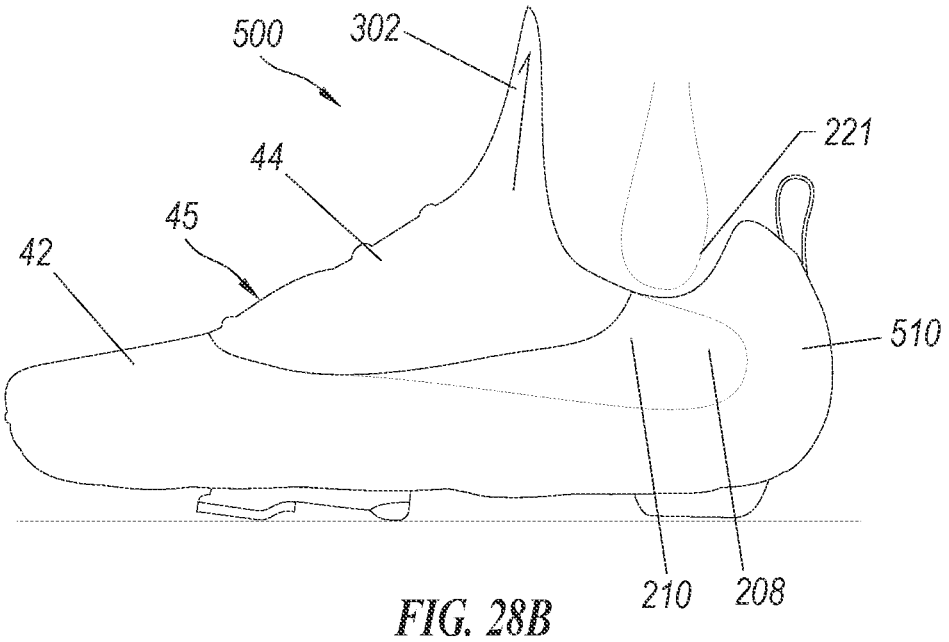

In another embodiment illustrated in FIGS. 28A and 28B, a footwear assembly 500 has a hybrid high-top configuration. In this embodiment, the dorsal shell 44 has as a posterior or high-top shin dorsiflexion portion 302 that extends upwardly over the ankle and a lower portion of the shin of the wearer's leg, but the dorsal shell 44 does not wrap around the medial and lateral portions of the ankle and the lateral malleolus. The heel portion 510 of the plantar shell 42 has a low-rise (or mid-rise) configuration with an upper edge below or adjacent to the wearer's ankle. This hybrid high-top shoe assembly 500 may or may not include a dorsal and plantar shell configuration with an overlapping or otherwise oriented engagement panel 208 and lateral wall portion 210 (FIG. 28B), as discussed above. The tall posterior portion 302 of the dorsal shell 44 provides integral or affixed dorsiflex portions (with or without the dorsiflex pads) that are engaged upon flex of the wearer's lower leg and ankle, so as to form a longer lever arm to transfer loads into the personalized caging system 45 for highly efficient power transfer, but the wearer's ankle can remain substantially uncovered by the rigid caging system 45 of the footwear assembly. In some embodiments, the posterior portion 302 can be generally stiff or inflexible (e.g., rigid) and configured to resist the dorsiflexive loads and maintain the neutral alignment of the wearer's foot during the pedal cycle. In other embodiments, at least part of the posterior portion 302 can be configured to bend or deflect in response to dorsiflexive motion of the wearer's foot, for example, so the posterior portion 302 can be positioned closer to the wearer's foot and/or lower leg compared to a more rigid posterior portion 302 and/or to improve the overall comfort and/or fit of the shoe assembly 500.

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

As used herein, the word "or" refers to any possible permutation of a set of items. For example, the phrase "A, B, or C" refers to at least one of A, B, and C, or any combination therefore, such as any of A; B; C; A and B; A and C; B and C; A, B, and C; or multiple of any item such as A and A; B, B, and C; A, A, B, C, and C; etc.

Although the subject matter has been described in language specific to structural features and/or methodological acts, it is to be understood that the subject matter defined in the appended claims is not necessarily limited to the specific features or acts described above. Specific embodiments and implementations have been described herein for purposes of illustration, but various modifications can be made without deviating from the scope of the embodiments and implementations. For example, one or more features described with reference to one shoe assembly (e.g., the shoe assembly 200) can be included as part of one or more of the other shoe assemblies (e.g., the shoe assembly 300, 400, and/or 500) described herein. The specific features and acts described above are disclosed as example forms of implementing the claims that follow. Accordingly, the embodiments and implementations are not limited except as by the appended claims.

We claim:

1. A cycling shoe, comprising:

a plantar shell that at least partially defines an interior area sized to receive a wearer's foot, the plantar shell having a plantar shell edge portion extending at least partially around an opening to the interior area and having a wall portion defining a side portion of a heel area of the interior area;

a dorsal shell having a dorsal shell edge portion configured to abut the plantar shell edge portion, and having an engagement panel projecting rearwardly away from the dorsal shell edge portion and configured to overlap the wall portion adjacent to the heel area of the interior area and at a side of the wearer's foot below the wearer's ankle and adjacent to a malleolus portion of the side of the wearer's foot; and a closure mechanism configured to detachably couple the dorsal shell to the plantar shell, wherein the engagement panel and the wall portion are positioned beneath the closure mechanism, with the engagement panel captured between the closure mechanism and the plantar shell's wall portion, such that the closure mechanism is configured to fixedly hold the engagement panel against the wall portion and to retain the dorsal shell with the dorsal shell edge portion against the plantar shell edge portion.

2. The cycling shoe of claim 1 wherein the wall portion is a lateral wall portion configured to be positioned adjacent to a lateral malleolus portion of the wearers foot, wherein the engagement panel is a lateral engagement panel extending posteriorly from a lateral side portion of the dorsal shell toward the lateral malleolus portion and configured to be aligned with the lateral wall portion, and wherein— the plantar shell further includes a medial wall portion opposite the lateral wall portion and configured to be positioned adjacent to a medial malleolus portion of the wearer's foot, the dorsal shell has a medial engagement panel extending posteriorly from a medial side portion of the dorsal shell toward the medial malleolus portion and configured to overlap with the medial wall portion, and the medial engagement panel and the medial wall portion are positioned beneath the closure mechanism such that the closure mechanism is configured to hold the medial engagement panel against the medial wall portion.

3. The cycling shoe of claim 2 wherein the closure mechanism is configured to hold the dorsal shell in firm engagement with the plantar shell and the wearer's foot via (i) the lateral wall portion and lateral engagement panel, (ii) the medial wall portion and medial engagement panel, and (iii) the abutting dorsal and plantar shell edge portions.

4. The cycling shoe of claim 1, wherein the dorsal shell further includes an intermediate engagement portion configured to contact an anterior malleolus portion of the wearer's foot, wherein the closure mechanism is configured to hold the intermediate engagement portion in contact with the anterior malleolus portion through a range of dorsiflexive motion of the wearer's foot.

5. The cycling shoe of claim 4 wherein the intermediate engagement portion is configured to extend upwardly away from the plantar shell to contact at least part of the wearer's lower leg.

6. The cycling shoe of claim 4 wherein the instep engagement portion includes a dorsiflexion pad configured to contact the anterior malleolus portion during the range of dorsiflexive motion of the wearer's foot.

7. The cycling shoe of claim 6 wherein the dorsiflexion pad is a first dorsiflexion pad positioned on a lateral side of the wearer's foot to contact an anterior lateral malleolus portion of the wearer's foot, the instep engagement portion further comprising a second dorsiflexion pad positioned on a medial side of the wearer's foot to contact a medial lateral malleolus portion of the wearer's foot.

8. The cycling shoe of claim 1 wherein the plantar shell includes a heel portion, and wherein the closure mechanism includes a strap configured to wrap at least partially around the heel portion and the dorsal shell.

9. The cycling shoe of claim 1 wherein the engagement panel and the wall portion are configured to inhibit pronation and/or supination of the wearer's foot.

10. The cycling shoe of claim 1 wherein the plantar shell further includes a heel portion, and wherein the closure mechanism is configured to hold the heel portion in contact with the wearer's foot during a range of dorsiflexive motion of the wearer's foot.

11. The cycling shoe of claim 10 wherein the closure mechanism is configured to apply a compressive force to the wearer's foot via the heel portion and the dorsal shell.

12. The cycling shoe of claim 1 wherein the dorsal shell and/or the plantar shell include a fiber-reinforced material 3-D printed based at least partially on scan data of the wearer's foot.

13. The cycling shoe of claim 1 wherein the plantar shell includes a first registration feature, wherein the dorsal shell includes a second registration feature, and wherein the first registration feature is configured to receive the second registration feature to position the dorsal shell relative to the plantar shell.

14. A footwear assembly, comprising:

a plantar shell that at least partially defines an interior area sized to receive a wearer's foot, wherein the plantar shell is shaped to conform to a lower portion of the wearer's foot and includes a heel portion having medial and lateral walls;

a dorsal shell shaped to conform to an upper portion of the wearer's foot, wherein the dorsal shell includes— a first portion positioned to overlap the medial wall of the heel portion and engage a medial side region of the wearer's foot below the wearer's ankle and adjacent to a medial malleolus portion of the medial side region of the wearer's foot, and a second portion positioned to overlap the lateral wall of the heel portion and engage a lateral side region of the wearer's foot below the wearer's ankle and adjacent to a lateral malleolus portion of the lateral side region of the wearer's foot; and a closure mechanism configured to couple the dorsal shell to the plantar shell, with the first and second portions of the dorsal shell captured between the closure mechanism and the medial and lateral walls, to (i) inhibit first movement of the wearer's foot, and (ii) inhibit second movement of the wearer's foot.

15. The footwear assembly of claim 14 wherein the first portion is a lateral engagement panel configured to contact an anterior lateral malleolus portion of the wearer's foot, and wherein the second portion is a medial engagement panel configured to contact a medial lateral malleolus portion of the wearer's foot.

16. The footwear assembly of claim 14 wherein the dorsal shell further includes a dorsiflexion portion positioned between the first and second portions and extending upwardly and rearwardly from the dorsal shell away from the plantar shell.

17. The footwear assembly of claim 14 wherein the first movement includes supination and/or pronation of the wearer's foot, and wherein the second movement includes dorsiflexion of the wearer's foot.

18. The footwear assembly of claim 14 wherein the plantar shell includes a third portion positioned to engage a third region of the wearer's foot to inhibit third movement of the wearer's foot.

19. The footwear assembly of claim 18 wherein the third portion is an ankle portion positioned to engage an ankle region of the wearer's foot, and wherein the third movement is plantarflexive movement of the wearer's foot.

20. The footwear assembly of claim 14 wherein the plantar shell includes a perimeter engagement portion, and wherein dorsal shell includes a perimeter edge portion configured to abut the perimeter engagement portion when the dorsal shell is coupled to the plantar shell.

21. A caging system for a footwear assembly to facilitate a wearer's performance in highly dynamic activities, the caging system comprising:

a plantar shell shaped to conform to a bottom portion of the wearer's foot, the plantar shell having (i) a medial wall portion, (ii) a lateral wall portion opposite the medial wall portion, (iii) an ankle portion between the medial wall portion and the lateral wall portion, the medial wall portion, the lateral wall portion, and the ankle portion at least partially defining an interior area sized to receive the wearer's foot, and (iv) a plantar shell edge portion extending at least partially around an opening to the interior area;

a dorsal shell shaped to conform to an upper portion of the wearer's foot, and configured to matingly engage with the plantar shell, the dorsal shell having (i) a medial engagement flange positioned to overlap with the medial wall portion at a medial malleolus portion of the wearer's foot, (ii) a lateral engagement flange opposite the medial engagement flange and positioned to overlap with the lateral wall portion at a lateral malleolus portion of the wearer's foot, (iii) an intermediate engagement portion between the medial engagement flange and the lateral engagement flange and positioned to align with an anterior malleolus portion of the wearer's foot, and (iv) a dorsal shell edge portion configured to abut the plantar shell edge portion; and a closure mechanism configured to couple the dorsal shell to the plantar shell to at least partially prevent movement of the dorsal shell relative to the plantar shell and position (i) the medial engagement flange relative to the medial wall portion, (ii) the lateral engagement flange relative to the lateral wall portion, and (iii) the dorsal shell edge portion relative to the plantar shell edge portion to hold the wearer's ankle in contact with the ankle portion.

22. The caging system of claim 21 wherein the medial engagement flange and the medial wall portion are configured to overlap one another beneath the closure mechanism, and wherein the lateral engagement flange and the lateral wall portion are configured to overlap one another beneath the closure mechanism.

23. The caging system of claim 21 wherein the medial engagement flange or the lateral engagement flange are positioned within the interior area of the plantar shell such that at least part of the dorsal shell overlaps at least part of the plantar shell when the dorsal shell is coupled to the plantar shell.

24. The caging system of claim 21 wherein the medial engagement flange and the lateral engagement flange are configured to inhibit a range of pronation or supination of the wearer's foot, wherein the intermediate engagement portion is configured to inhibit a range of dorsiflexive motion of the wearer's foot, and wherein the ankle portion is configured to inhibit a range of plantarflexive motion of the wearer's foot.

* * * * *